US011199126B2

(12) United States Patent
Narasimha Murthy

(10) Patent No.: US 11,199,126 B2
(45) Date of Patent: Dec. 14, 2021

(54) INTERNAL COMBUSTION ENGINE WITH SPLIT CYLINDER AND FREE PISTON AND POWER GENERATION USING THE SAME

(71) Applicant: P L Ahobala Narasimha Murthy, Bangalore (IN)

(72) Inventor: P L Ahobala Narasimha Murthy, Bangalore (IN)

( * ) Notice: Subject to any disclaimer, the term of this patent is extended or adjusted under 35 U.S.C. 154(b) by 0 days.

(21) Appl. No.: 17/269,537

(22) PCT Filed: Aug. 21, 2019

(86) PCT No.: PCT/IB2019/057046

§ 371 (c)(1),
(2) Date: Feb. 19, 2021

(87) PCT Pub. No.: WO2020/044176

PCT Pub. Date: Mar. 5, 2020

(65) Prior Publication Data

US 2021/0180509 A1 Jun. 17, 2021

(30) Foreign Application Priority Data

Aug. 31, 2018 (IN) ..... 201841032739
Mar. 13, 2019 (IN) ..... 201943009748

(51) Int. Cl.
*F02B 33/22* (2006.01)
*F02B 63/04* (2006.01)
*F02B 71/00* (2006.01)

(52) U.S. Cl.
CPC ..... *F02B 33/22* (2013.01); *F02B 63/042* (2013.01); *F02B 71/00* (2013.01)

(58) Field of Classification Search
CPC ..... F02B 33/22; F02B 63/042; F02B 71/00; F02B 33/06; F02B 33/02
See application file for complete search history.

(56) References Cited

U.S. PATENT DOCUMENTS

2015/0315959 A1* 11/2015 Tour ..... F01L 7/02 123/70 R
2018/0266308 A1* 9/2018 Tour ..... F01L 7/02

* cited by examiner

*Primary Examiner* — Jacob M Amick

(57) ABSTRACT

The present invention provides an internal combustion engine with a split cylinder and free piston. The internal combustion engine (100) comprises a first chamber (200) having pumping means (202) disposed therein, wherein the first chamber (200) is configured to pump air or a charge, a second chamber (400) having second piston (402) disposed therein, the first chamber (200) is connected to and in fluid communication with the second chamber (400) and is configured to receive the air or charge from the first chamber (200) or from a source of compressed air thereof selected from the group consisting of compressors or pre-compressed air, and a third chamber (600) having third piston (602) disposed therein, the third chamber (600) is configured to receive a fluid therein and the third piston (602) is operably coupled to the second piston (402), and a second locking mechanism (1000) and/or a first locking mechanism (800).

19 Claims, 10 Drawing Sheets

INTERNAL COMBUSTION ENGINE WITH SPLIT CYLINDER AND FREE PISTON AND POWER GENERATION USING THE SAME

FIELD OF THE INVENTION

The present invention relates to internal combustion engines with a split cylinder and free piston and generating power using the same.

BACKGROUND OF THE INVENTION

Herbert Albert Humphery, a British inventor, patented the use of the internal combustion engine for pumping water in the year 1906. The Humphery pump comprised of a large U-shaped tube filled with water. The water column so formed in the U-shaped tube was used as a piston to push out water, wherein gas pressure was created by combusting fuel in a closed space or by internal combustion of fuel. The water is lifted up in the U-shaped tube to be delivered higher altitude.

The Russian patent No. 2307958 discloses an impulse water-jet pump. More specifically, Russian patent No. 2307958 discloses an impulse water-jet pump for use in mini-thermoelectric plants, agriculture, and fire-fighting equipment. The impulse water-jet pump is comprised of a pipeline, lower and upper pressure tanks with combustion chamber installed in between which is provided with intake and outlet valves and spark plug. The impulse water-jet pump further includes a nozzle to discharge water and impact valve installed between the combustion chamber and the upper pressure tank to close passage to the upper pressure tank, and valve consisting of movable needle-rod arranged in nozzle and secured on a piston connected with spring. The impulse water-jet pump provides increased velocity of water discharge.

The U.S. Pat. No. 4,777,801 discloses an energy conversion apparatus, wherein the apparatus is two staged and operates on a non-polluting fuel. In particular, a single-cylinder reciprocating engine converts combustion energy to mechanical energy. Mechanical energy developed in the reciprocating engine is transmitted or coupled to a turbine by means of a transmission fluid flowing in a closed loop system interconnecting the reciprocating engine and the turbine.

One disadvantage of the internal combustion engine is that a substantial amount of heat energy is lost in exhaust gases, which are expelled to the atmosphere.

Thus, there is felt an acute need for overcoming one or more drawbacks associated with the conventional internal combustion engines.

OBJECTS OF THE INVENTION

Some of the objects of the presently disclosed invention, of which at the minimum one object is fulfilled by at least one embodiment disclosed herein, are as follows:

An object of the presently disclosed invention is to provide an alternative, which overcomes at least one drawback encountered in the existing prior art.

Another object of the present invention is to provide an internal combustion engine.

Still another object of the present invention is to provide an internal combustion engine, which can minimize or eliminate loss of the heat energy in the exhaust gases expelled to the atmosphere.

Yet another object of the present invention is to provide an internal combustion engine, which employs the heat and pressure in the combustion product gases and converts it into mechanical energy more particularly into high velocity water jet.

Yet another object of the present invention is to provide an embodiment to generating electric power using the internal combustion engine disclosed herein.

Other objects and benefits of the present invention will be more apparent from the following description, which is not intended to bind the scope of the present invention.

SUMMARY OF THE INVENTION

The present invention provides internal combustion engines with a split cylinder and free piston to generate power using the same.

In accordance with an embodiment, the internal combustion engine comprising a first chamber having a pumping means disposed therein, wherein the first chamber is configured to pump air or charge, a second chamber having a second piston disposed therein, the second chamber is connected to and in fluid communication with the first chamber, the second chamber is configured to receive air or charge from the first chamber or from a source of compressed air thereof, and a third chamber having a third piston disposed therein, the third piston operatively coupled to the second piston and the third chamber configured to receive a fluid therein and eject the fluid thereout, and a second locking mechanism configured to lock the movement of an elongated element and thereby restrict the movement of the second piston.

In accordance with another embodiment, the internal combustion engine comprising a first chamber having a pumping means disposed therein, wherein the first chamber is configured to pump air or charge, a second chamber having a second piston disposed therein, the second chamber is connected to and in fluid communication with the first chamber, the second chamber is configured to receive air or charge from the first chamber or from a source of compressed air thereof, and a third chamber having a third piston disposed therein, the third piston operatively coupled to the second piston and the third chamber configured to receive a fluid therein and eject the fluid thereout, and a first locking mechanism applied on a nozzle on the third chamber wherein the first locking mechanism is configured to lock the movement of the third piston by selectively allowing the flow out of the fluid from the third chamber.

In accordance with another embodiment, the internal combustion engine comprising a first chamber having a pumping means disposed therein, wherein the first chamber is configured to pump air or charge, a second chamber having a second piston disposed therein, the second chamber is connected to and in fluid communication with the first chamber, the second chamber is configured to receive air or charge from the first chamber or from a source of compressed air thereof, and a third chamber having a third piston disposed therein, the third piston operatively coupled to the second piston and the third chamber configured to receive a fluid therein and eject the fluid thereout, and a second locking mechanism configured to lock the movement of an elongated element and thereby restrict the movement of the second piston and a first locking mechanism applied on a nozzle on the third chamber wherein the first locking mechanism is configured to lock the movement of the third piston by selectively allowing the flow out of the fluid from the third chamber.

In a further embodiment, the internal engine further comprises of or a second locking mechanism configured to lock the movement of an elongated element and thereby restrict the movement of the second piston or both the first locking mechanism applied on a pipe or a nozzle and second locking mechanism configured to lock the movement of an elongated element.

In accordance with an embodiment, the first chamber comprising of a first cylinder having a first operative end and a second operative end, the pumping means reciprocally disposed in the cylinder configured to move sliding reciprocally to and from the first operative end and the second operative end within the first cylinder, a first cylinder head disposed sealed on the first operative end of the first cylinder, a first space defined by the walls of the first cylinder, the first cylinder head and the pumping means to receive air from the atmosphere, a first inlet port configured in the first cylinder head to draw the air therethrough from the atmosphere or a source thereof into the first space, a first inlet valve received within the first inlet port, a first outlet port configured in the first cylinder head to eject the air or the charge therethrough to the second chamber, a cooling jacket disposed optionally on an outer operative surface of the first cylinder for circulating a cooling fluid therethrough, a cooling jacket is disposed optionally on an outer operative surface of the first cylinder head for circulating a cooling fluid therethrough, and a fuel injector optionally provided in the first chamber to add fuel to the air drawn from the atmosphere to form an air fuel mixture or the charge.

Further, the first cylinder head comprises a cylindrical barrel having a first end and a second end, and the second end is opening in the first space. The pumping means is a first piston having a first operative surface and a second operative surface, an elongated element is secured to the first piston passing therethrough, having a first portion disposed above the first operative surface of the first piston and a second portion disposed below the second operative surface of the first piston, and the first portion of the elongated element being receivable within the cylindrical barrel.

In a further embodiment, the second operative end of the first cylinder is closed and the first space is defined by and/or enclosed within the first cylinder head, the walls of the first cylinder and the closed second operative end of the first cylinder. The closed second operative end comprises a second inlet port configured to fill an incompressible liquid therethrough into the first chamber, to act as a pumping means for pumping or pushing the air or the charge into a second chamber, a second inlet valve received in the second inlet port, a second outlet port configured to remove the incompressible liquid therethrough from the first chamber to draw in air from the atmosphere or a source through the first inlet port, and a second outlet valve received in the second outlet port.

In accordance with an embodiment, the second chamber comprises of a second cylinder having a first operative end and a second operative end, the second piston reciprocally disposed in the second cylinder configured to move sliding reciprocally to and from the first operative end and the second operative end within the second cylinder, a second cylinder head disposed sealed on the first operative end of the second cylinder, a second space defined by the walls of the second cylinder of the second chamber, the second cylinder head, and the second piston for receiving there within the air or the charge from the first chamber or from a source of compressed air thereof, a third inlet port configured in the second cylinder head to receive air or charge from the first chamber via the first outlet port or from a source of compressed air thereof, a third inlet valve received in the third inlet port, a third outlet port configured in the second cylinder head to eject the exhaust gases therethrough to atmosphere, a third outlet valve received in the third outlet port, a cooling jacket disposed on an outer operative surface of the second cylinder for circulating a cooling fluid therethrough, a cooling jacket disposed on an outer operative surface of the second cylinder head for circulating a cooling fluid therethrough, and a fuel injector optionally provided in the second chamber to add fuel to the air received from the first chamber to form an air fuel mixture or the charge or to bring about the compression ignition.

In accordance with an embodiment, the third chamber comprises of a third cylinder having an open first operative end and a closed second operative end, the third piston reciprocally disposed in the third cylinder configured to move sliding, reciprocally to and from the open first operative end and the closed second operative end within the third cylinder, and the third cylinder disposed operatively next to the second chamber, wherein the second operative end of the second cylinder of the second chamber is facing the open first operative end of the third cylinder of the third chamber, an elongated element coupling the second piston and the third piston, a third space defined by the closed second operative end, the third piston, and the walls of the third cylinder of the third chamber for receiving a fluid therein, a pipe or a nozzle configured on the closed second operative end of the third cylinder of the third chamber and the pipe or the nozzle is configured to selectively facilitate the pumping out of the fluid from the third chamber, a fourth inlet port configured on the closed second operative end of the third cylinder of the third chamber adapted to receive a fluid from a fluid source and facilitate passage of the fluid therethrough into the third chamber from the fluid source, and a fourth inlet valve operably received in the fourth inlet port.

In a further embodiment, the open first operative end of the third cylinder of the third chamber is joined sealed with the second operative end of the second cylinder of the second chamber, and the second piston and the third piston are optionally coupled operatively by filling a liquid between the second piston and the third piston in place of the elongated element.

In a further embodiment, the second piston, the third piston and the operative coupling between the second piston and the third piston are removed and a liquid in third chamber is directly subjected to gas force due to pressure in combustion product gases in the second chamber.

In accordance with an embodiment, the first locking mechanism is configured on the pipe or the nozzle to selectively allow passage of the liquid from the third chamber to a utility and the first locking mechanism comprises of a housing defined by a cylinder having first operative end and second operative end, a first end plate disposed sealed on the second operative end of the cylinder, wherein the first end plate is having a first operative surface and a second operative surface, and a second end plate disposed sealed on the first operative end of the cylinder wherein the second end plate is having first operative surface and second operative surface, a space defined by and/or enclosed in the cylinder, the first end plate and the second end plate, a first aperture in the second end plate, a second aperture in the second end plate spaced apart from the first aperture, a first tubular member attached to the first aperture on the second operative surface of the second end plate, a first magnet attached to the second operative surface of the second end plate, abutting the first tubular member, a third tubular member attached to the second aperture on the first operative surface of the second end plate and disposed extended to outside, a through-hole provided therein the third tubular member, a first aperture in the first end plate, a second aperture in the first end plate spaced apart from the first aperture, a second tubular member attached to the first aperture on the second operative surface of the first end plate, a second magnet attached to the second operative surface of the first end plate abutting the second tubular member, a fourth tubular member attached to the second aperture on the first operative surface of the first end plate and disposed extended to outside, a through-hole provided therein in the third tubular member, a substantially cylindrical chunk having a first operative surface and a second operative surface made of metal from group of metals including iron, cobalt, nickel which are attracted by magnets, disposed in the space configured to move sliding reciprocally to and from the first operative end and the second operative end of the cylinder, a first elongated bar having a first end and a second end disposed attached to the first operative surface of the substantially cylindrical chunk with the second end and the first end of the first elongated bar is displaceably received in the first tubular member, a second elongated bar having a first end and a second end disposed attached to the second operative surface of the substantially cylindrical chunk with the second end and the first end of the second elongated bar is displaceably received in the first tubular member, a third elongated bar having a first end, a second end and hole substantially close to the first end disposed attached to the first operative surface of the substantially cylindrical chunk with the second end spaced apart from first elongated bar and the first end of the third elongated bar is displaceably received in the third tubular member, and a fourth elongated bar having a first end, a second end and hole substantially close to the first end disposed attached to the second operative surface of the substantially cylindrical chunk with the second end spaced apart from second elongated bar and the first end of the fourth elongated bar is displaceably received in the third tubular member.

In a further embodiment, the first locking mechanism is connected to the pipe or the nozzle comprising of an aperture configured in the wall of the pipe or the nozzle to which the first aperture in the second end plate of the first locking mechanism is joined forming a watertight passage through the first aperture in the wall of pipe or nozzle, the first aperture in second end plate and the first tubular member on second end plate, wherein the first elongated bar is received disposed reciprocally displaceable, and a through hole configured in the wall of the pipe or the nozzle wherein the third tubular member on second end plate enters such that the through hole in the third tubular member register in line with the pipe or the nozzle allowing flow of the fluid and the third elongated bar is disposed reciprocally displaceable in the third tubular member to selectively block the flow of the fluid through the pipe or the nozzle.

In a further embodiment, the first locking mechanism is shared with a second internal combustion engine connected to the pipe or the nozzle of the second internal combustion engine comprising of an aperture configured in the wall of the pipe or the nozzle to which the first aperture in the first end plate of the first locking mechanism is joined forming a watertight passage through the first aperture in the wall of pipe or nozzle, the first aperture in first end plate and the second tubular member on first end plate, wherein the first elongated bar is received disposed reciprocally displaceable, and a through hole configured in the wall of the pipe or the nozzle wherein the fourth tubular member on first end plate enters such that the through hole in the fourth tubular member register in line with the pipe or the nozzle allowing flow of the fluid and the fourth elongated bar is disposed reciprocally displaceable in the fourth tubular member to selectively block the flow of the fluid through the pipe or the nozzle.

In accordance with an embodiment, the second locking mechanism is configured to selectively lock the movement of the elongated element thereby arrest the movement of the second piston) and the second locking mechanism comprises of at least one wedge shaped shoe having a first edge, a second edge, and a third edge, a support extending from inner walls of the second cylinder of the second chamber on which the at least one wedge shaped shoe pivotally secured at the first edge thereof, a cylinder, a pressure relief valve configured on the cylinder, a piston reciprocally received in the cylinder, a connecting rod having a first end pivotally connected at the second edge of the at least one wedge shaped shoe and a second end pivotally connected to the piston, and a groove having a shape complimentary to the shape of the third edge of the at least one wedge shaped shoe configured on the elongated element to receive the third edge of the at least one wedge shaped shoe therein in a locking mode wherein the cylinder therein receives a pressurized fluid, thereby displacing the piston causing a sequence of movements in which the piston displaces the connecting rod which in turn displaces the second edge of the at least one wedge shaped shoe, thereby rotating the at least one wedge shaped shoe around the first edge thereof moving the third edge of the at least one wedge shaped shoe into the groove in the elongated element thereby locking the movement of the elongated element and thereby arresting the movement of the second piston, and in a non-locking mode, fluid in the cylinder is drawn out or pushed out by the force on the second piston due to pressure in the second chamber, causing a sequence of movements wherein the piston is displaced towards the wall of the cylinder, which in turn displaces the connecting rod, which displaces the second edge thereby rotating the at least one wedge shaped shoe around the first edge thereof, slipping the third edge displaced off from the groove, thereby unlocking the elongated element and thereby facilitating the movement of the second piston and the third piston.

In accordance with an embodiment, a rack and pinion mechanism is disposed operatively above the first cylinder head and the second cylinder head, wherein the rack and pinion mechanism comprises of a rack having a first end and a second end, the first end along with a portion of the rack is protruding into the first space in the first chamber through an aperture in a sealable manner, and the second end is coupled to a resilient member, a pinion meshing with the rack, the pinion disposed rotating on a support, and a cam meshing with the pinion, disposed rotating on a support, the cam coupled to the second inlet valve, wherein the first piston comes in contact with the first end in the process of pumping out the air or the charge from the first chamber, and pushes the first end thereby moving the rack compressing the resilient member, and the pinion is rotated which in turn rotates the cam moving the cam off from the second inlet valve allowing the second inlet valve to close.

In accordance with an embodiment, at least one fluid pump is configured in the third chamber and the at least one fluid pump comprises of a cylindrical chamber closed on both ends having a first operative end facing the closed second operative end of the third cylinder and a second operative end towards the open first operative end of the third cylinder, a first opening to the cylindrical chamber in the first operative end, a second opening to the cylindrical chamber in the second operative end receiving therein a outlet valve through which fluid is ejected from the cylindrical chamber, a third opening to the cylindrical chamber in the second operative end receiving therein an inlet valve through which fluid is received into the cylindrical chamber, a piston having a first operative surface facing the second operative end of the cylindrical chamber and a second operative surface facing the first operative end of the cylindrical chamber, reciprocally disposed to move sliding in the cylindrical chamber, an elongated element secured to the second operative surface of the piston and emerging out of the cylindrical chamber through the first opening, a resilient member/spring is attached to the free end of the elongated element, wherein the elongated element comes in contact with the piston just before the conclusion of exhaust stroke pushing the elongated element along with piston towards second operative end pushing out the fluid in cylindrical chamber, and at the commencement of the power stroke as the piston move towards the closed second operative end, the elongated element is detached from the contact of the piston, the restoring forces in resilient member or spring attached to elongated element pull out the elongated element from the cylindrical chamber moving the piston to first operative end drawing in fluid into the cylindrical chamber.

In a further embodiment, the first locking mechanism comprise at least one fluid pump, wherein the at least one fluid pump comprises of a closed cylindrical chamber having a first operative end attached to the second operative surface of second end plate and a second operative end extended into the space facing the first operative surface of the substantially cylindrical chunk, a first opening in the wall on the second operative end facing the first operative surface of the substantially cylindrical chunk, a second opening in the wall on the first operative end, receiving a outlet valve through which fluid is ejected from the cylindrical chamber, a third opening in the wall on the first operative end, receiving a inlet valve through which fluid is received into the cylindrical chamber, a piston is reciprocally disposed within the cylindrical chamber configured to move sliding to and from the first operative end and the second operative end within the cylindrical chamber, a connecting rod having one end connected to the piston and other end connected to the first operative surface of substantially cylindrical chunk passing through the first opening, wherein the displacement of the substantially cylindrical chunk away from the second end plate displace the piston drawing in fluid through the second opening into the cylindrical chamber and the displacement of the substantially cylindrical chunk towards the second end plate displace the piston pumping out fluid from the cylindrical chamber through the third opening.

In a further embodiment, the first locking mechanism comprise at least one fluid pump and the at least one fluid pump comprises of a closed cylindrical chamber having a first operative end attached to the second operative surface of the first end plate and a second operative end extended into the space facing the second operative surface of the substantially cylindrical chunk, a first opening in the wall on the second operative end facing the second operative surface of the substantially cylindrical chunk, a second opening in the wall on the first operative end, receiving a outlet valve through which fluid is ejected from the cylindrical chamber, a third opening in the wall on the first operative end, receiving a inlet valve through which fluid is received into the cylindrical chamber, a piston is reciprocally disposed within the cylindrical chamber configured to move sliding to and from the first operative end and the second operative end within the cylindrical chamber, a connecting rod having one end connected to the piston and other end connected to the second operative surface of substantially cylindrical chunk passing through the first opening, wherein the displacement of the substantially cylindrical chunk away from the first end plate displace the piston drawing in fluid through the third opening into the cylindrical chamber and the displacement of the substantially cylindrical chunk towards the first end plate displace the piston pumping out fluid from the cylindrical chamber through the second opening.

In accordance with an embodiment, the valves in any one of the or in all the ports in the internal combustion engine, particularly the first inlet port, the second inlet port, the third inlet port, the second outlet port, the third outlet port and the fourth inlet port is/are actuated by a hydraulic valve system comprising at least one fluid pump in third chamber, at least one fluid pump in the first lock mechanism and at least one fluid pump in the first lock mechanism connected through conduits and valves.

In accordance with an embodiment, the first chamber is an air or charge injector, the second chamber is a combustion chamber, and the third chamber is an ejector.

In accordance with an embodiment, an electric power generating system comprising of at least one the internal combustion engine, a funnel shaped container having a broad end and a narrow end, wherein the internal combustion engine or the internal combustion engines is/are operatively coupled to the funnel shaped container on broad end to discharge liquid into the funnel shaped container and the liquid is allowed to flow out from the narrow end of the funnel shaped container, a turbine operatively coupled to the narrow end of the funnel shaped container and the turbine is rotated by the liquid flowing out from the narrow end of the funnel shaped container, a dynamo or an alternator or electric power producing equipment selected from the group consisting of dynamo and alternator, operatively coupled to the turbine to generate electric power.

BRIEF DESCRIPTION OF THE ACCOMPANYING DRAWING

The present invention will now be described with the help of the accompanying drawing, in which.

Figure 1A:
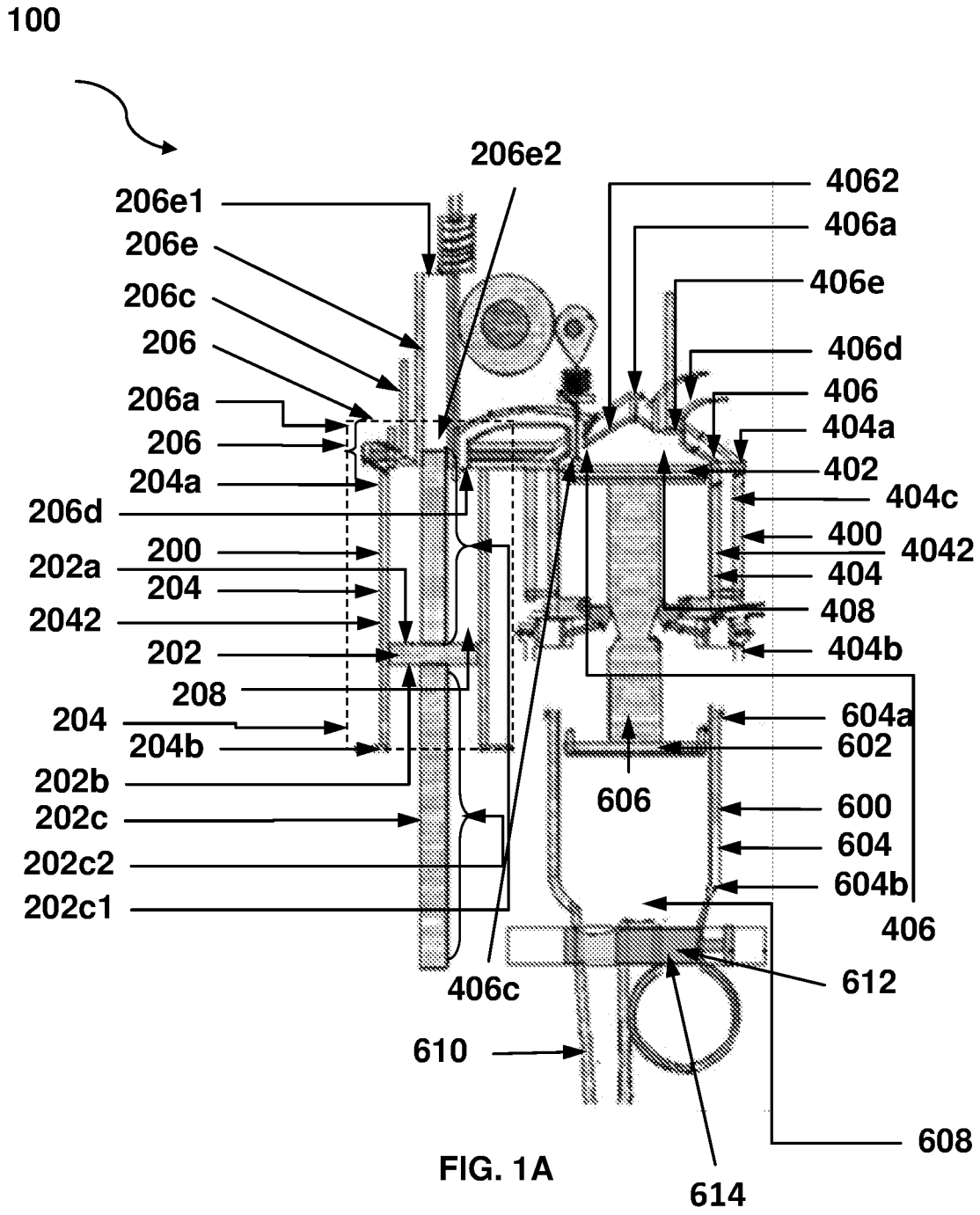
FIG. 1A illustrates a schematic view of an internal combustion engine in accordance with the embodiments of the present invention, according to an embodiment herein.

| LIST OF NUMERALS | |
|---|---|
| 100 | Internal combustion engine |
| 200 | First chamber |
| 202 | Pumping means or First piston |
| 202a | First operative surface |
| 202b | Second operative surface |
| 202c | Elongated element |
| 202c1 | First portion of the elongated element |
| 202c2 | Second portion of the elongated element |
| 204 | First cylinder |
| 204a | First operative end |
| 204b | Second operative end |
| 204bi | Second inlet port |
| 204bo | Second outlet port |
| 204bV1 | Second inlet valve |
| 204bV2 | Second outlet valve |
| 204c | Cooling jacket |
| 2042 | Outer operative surface |
| 206 | First Cylinder head |
| 206a | Cooling jacket |
| 206b | First inlet port |
| 206c | First inlet valve |
| 206d | First outlet port |
| 206e | Cylindrical barrel |
| 206e1 | First end |
| 206e2 | Second end |
| 208 | First Space |
| 400 | Second chamber |
| 402 | Second piston |
| 404 | Second Cylinder |
| 404a | First operative end |
| 404b | Second operative end |
| 404c | Cooling jacket |
| 4042 | Outer operative surface |
| 406 | Second Cylinder head |
| 406a | Cooling jacket |
| 406b | Third inlet port |
| 406c | Third inlet valve |
| 406d | Third outlet port |
| 406e | Third outlet valve |
| 4062 | Outer operative surface |
| 408 | Second Space |
| 4042 | Outer operative surface |
| 600 | Third chamber |
| 602 | Third piston |
| 604 | Third Cylinder |
| 604a | First operative end |
| 604b | Second operative end |
| 606 | Elongated element |
| 608 | Third Space |
| 610 | Pipe or Nozzle |
| 610ap | Aperture |
| 610H | Through Hole |
| 612 | Fourth inlet port |
| 614 | Fourth inlet valve |
| 616 | Fluid Pumps |
| 616a | Cylindrical chamber |
| 616a1 | First operative end |
| 616a2 | Second operative end |
| 616b | Piston |
| 616bE | Elongated element |
| 616c | First opening |

-continued

| LIST OF NUMERALS | |
|---|---|
| 616d1 | Second opening |
| 616d2 | Third opening |
| 800 | First locking mechanism |
| 802 | Housing |
| 802a | Cylinder |
| 802a1 | First operative end |
| 802a2 | Second Operative end |
| 802b | First end plate |
| 802b1 | First operative end |
| 802b2 | Second operative end |
| 802bH1 | First aperture |
| 802bH2 | Second aperture |
| 802c | Second end plate |
| 802c1 | First operative surface |
| 802c2 | Second operative surface |
| 802cH1 | First aperature |
| 802cH2 | Second aperature |
| 802cM | First magnet |
| 802bM | Second magnet |
| 804 | Cylindrical chunk |
| 804a1 | First operative surface |
| 804a2 | Second operative surface |
| 806 | First tubular member |
| 806a | First elongated bar |
| 806a1 | First end |
| 806a2 | Second end |
| 807 | Second tubular member |
| 807a | Second elongated bar |
| 807a1 | First end |
| 807a2 | Second end |
| 808 | Space |
| 810 | Third tubular member |
| 810a | Third elongated bar |
| 810a1 | First end |
| 810a2 | Second end |
| 810ah | Hole |
| 811 | Fourth tubular member |
| 811a | Fourth elongated bard |
| 811a1 | First end |
| 811a2 | Second end |
| 811ah | Hole |
| 811h | Thorugh-hole |
| 812 | Fluid pump |
| 812a | Closed cylindrical chamber |
| 812a1 | First operative end |
| 812a2 | Second operative end |
| 812b | Piston |
| 812br | Connecting rod |
| 812br1 | First end |
| 812br2 | Second end |
| 812d1 | Second opening |
| 812d2 | Third opening |
| 814 | Fluid pump |
| 814a | Closed cylindrical chamber |
| 814a1 | First operative end |
| 814a2 | Second operative end |
| 814c | First opening |
| 814d1 | Second opening |
| 814d2 | Third opening |
| 814br | Connecting rod |
| 814br1 | First end |
| 814br2 | Second end |
| 1000 | Second locking mechanism |
| 1002 | One wedge shaped shoe |
| 1002a | First edge |
| 1002b | Second edge |
| 1002c | Third edge |
| 1004 | Groove |
| 1006 | Connecting rod |
| 1006a | First end |
| 1006b | Second end |
| 1008 | Piston |
| 1010 | Cylinder |
| 1010a | Pressure relief valve |
| 1012 | Support |
| 1200 | Rack and pinion mechanism |
| 1202 | Rack |

-continued

| LIST OF NUMERALS | |
|---|---|
| 1202a | First end |
| 1202b | Second end |
| 1204 | Pinion |
| 1206 | Cam |
| 1208 | Resilient member |

DETAILED DESCRIPTION

All technical terms and scientific expressions used in the present invention have the same meaning as understood by a person skilled in the art to which the present invention belongs, unless and otherwise specified.

As used in the present specification and the claims, the singular forms "a", "an" and "the" include plural references unless the context clearly dictates otherwise.

The term "comprising" as used in the present specification will be understood to mean that, the list following is non-exhaustive and may or may not include any other extra suitable things, for instance one or more additional feature(s), part(s) and/or constituent(s) as applicable.

Further, the terms "about" and "approximately" used in combination with ranges of sizes of parts, and/or any other physical properties or characteristics, are meant to include small variations that may occur in the upper and/or lower limits of the ranges of sizes.

The present invention provides an internal combustion engine, which has split cylinder and free piston configuration, which can be employed for generating power.

More specifically, the present invention provides an internal combustion engine, which overcomes one or more drawbacks of the conventional internal combustion engine, wherein the loss of heat energy in exhaust gases, which are expelled to the atmosphere, is either reduced or completely eliminated.

Figure 1B:
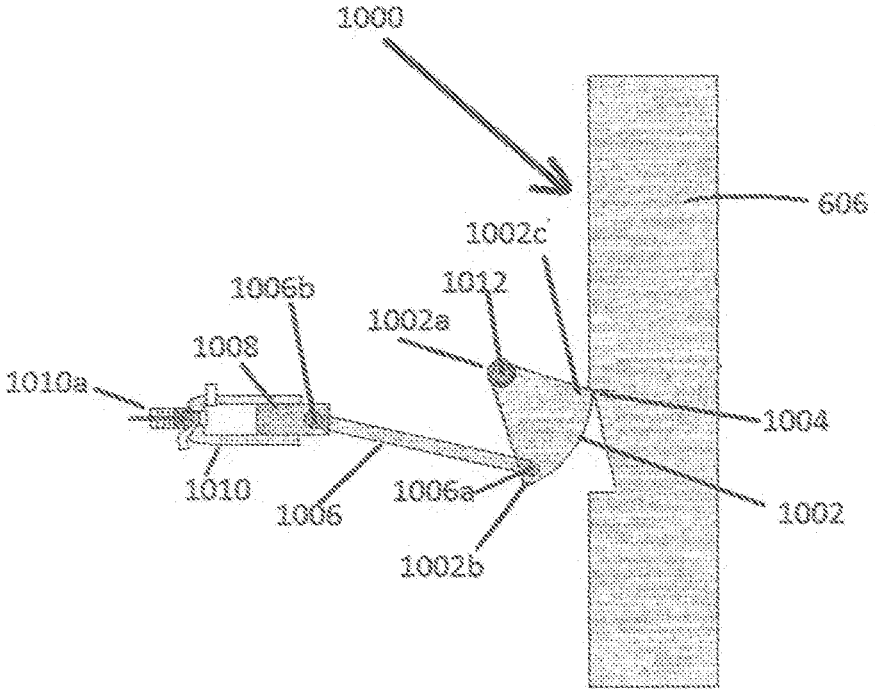
FIG. 1B illustrates a schematic view of a second locking mechanism (1000) configured to selectively lock the movement of an elongated element (606) connecting a second piston (402) of a second chamber (400) and the third piston (602) of the third chamber (600), according to an embodiment herein.
Figure 1C:
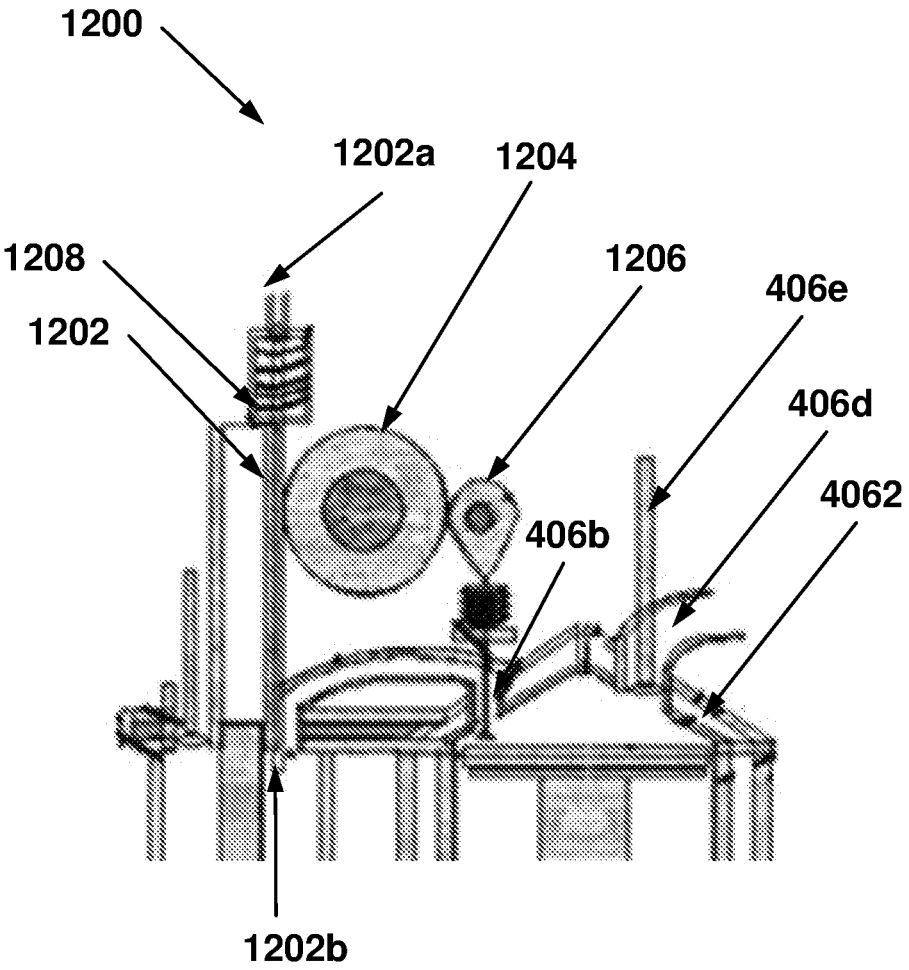
FIG. 1C illustrates a schematic view of a rack and pinion mechanism (1200) disposed operatively above a first cylinder head (206) and a second cylinder head (406), according to an embodiment herein.
Figure 1D:
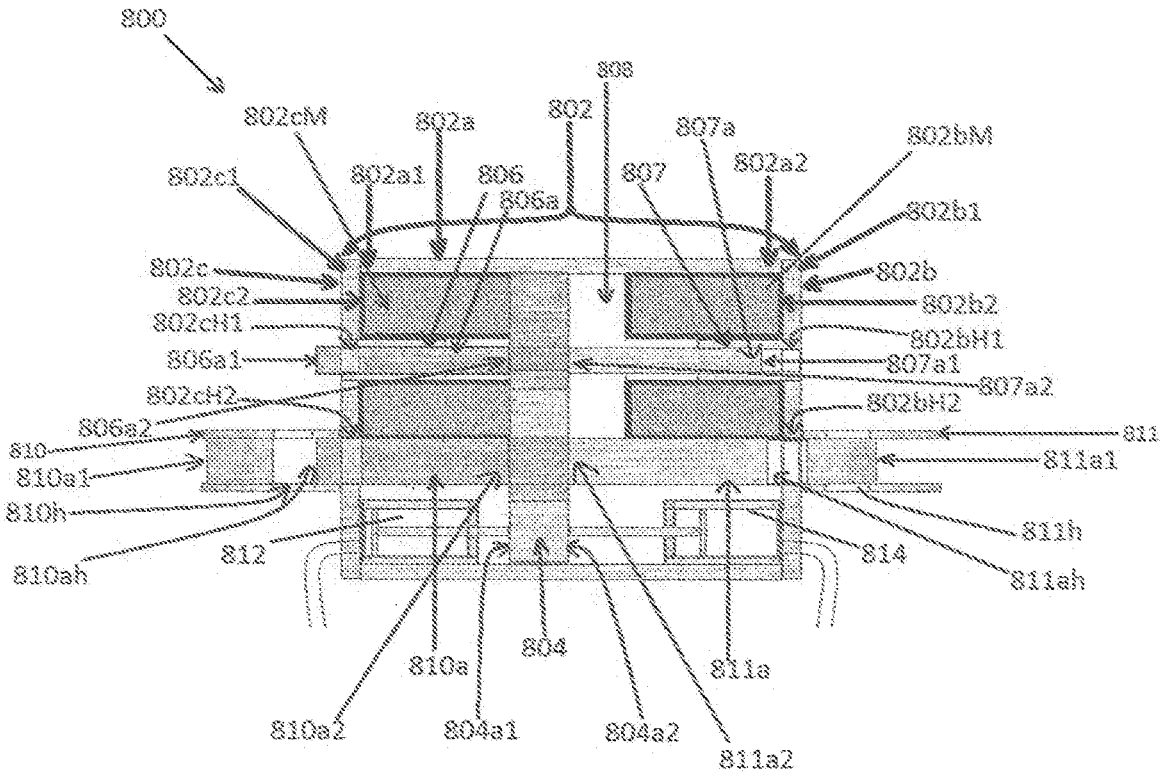
FIG. 1D illustrates a schematic view of a first locking mechanism (800), according to an embodiment herein.
Figure 1E:
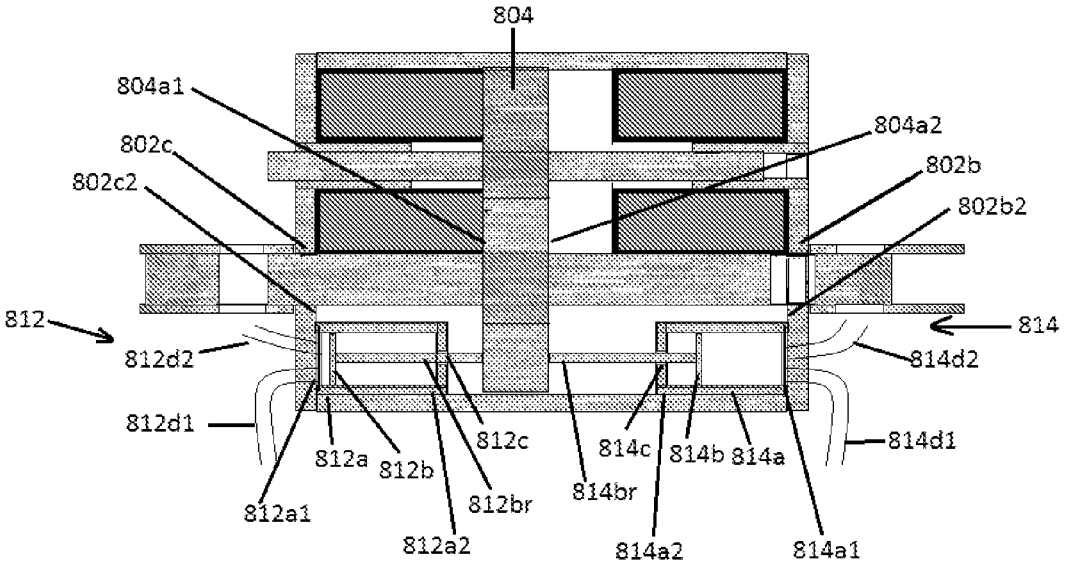
FIG. 1E illustrates a schematic view of a fluid pump (812) and a fluid pump (814) in the first locking mechanism (800), according to an embodiment herein.
Figure 1F:
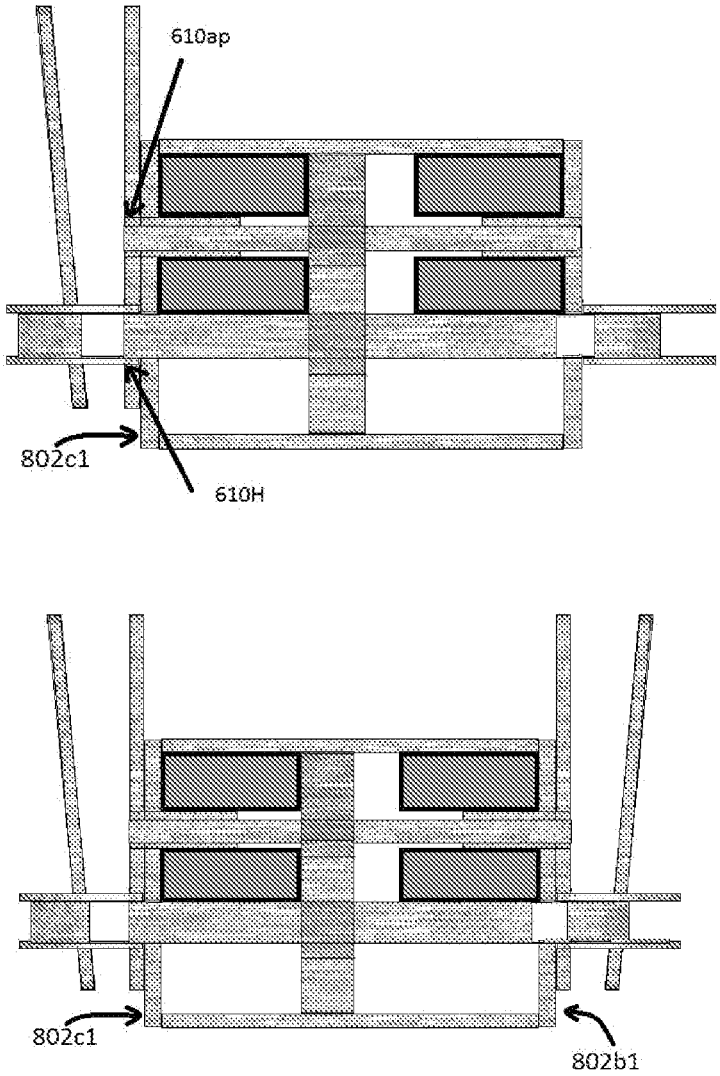
FIG. 1F illustrates a schematic view of a first locking mechanism (800) connected to a pipe (610) or a nozzle (610) emerging from the third chamber (600) of the internal combustion engine, according to an embodiment herein.
Figure 1G:
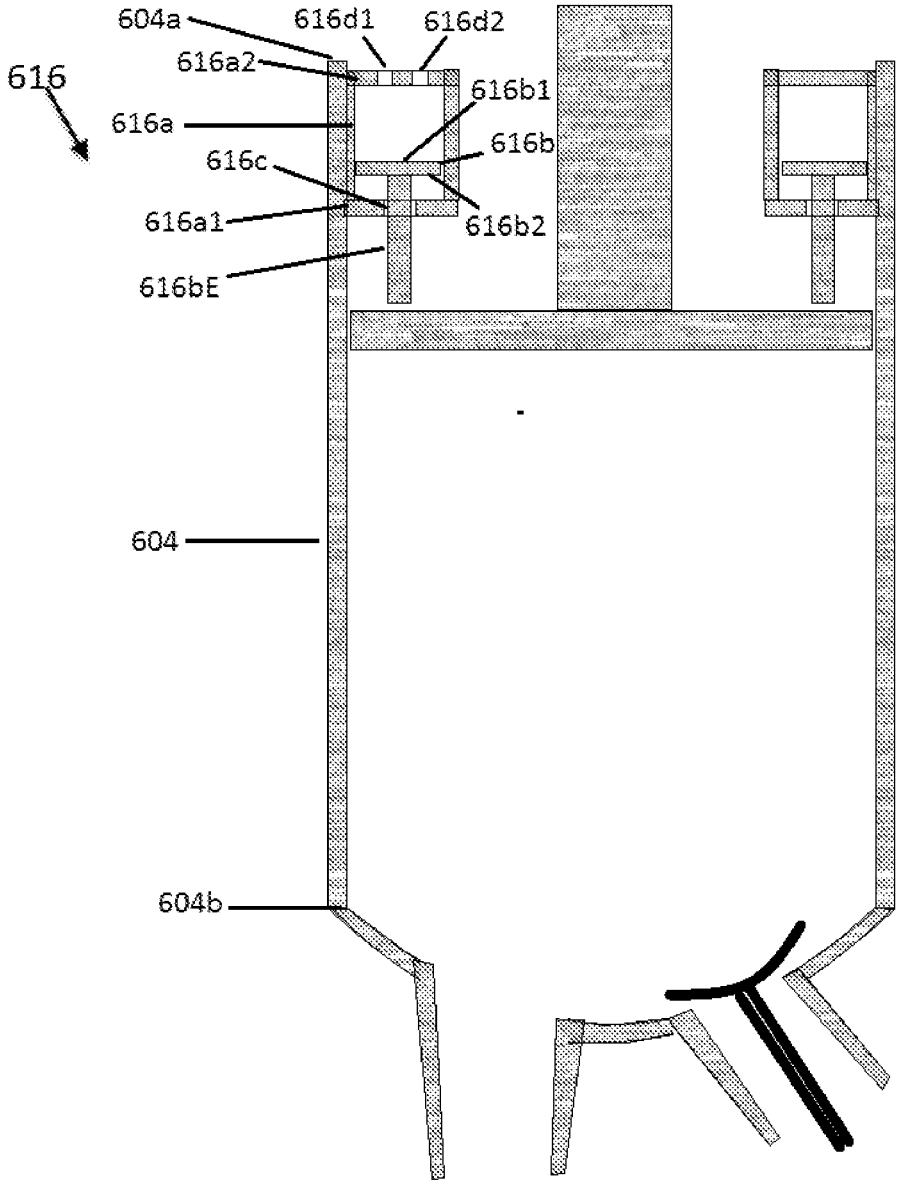
FIG. 1G illustrates schematic view of fluid pump (616) in a third cylinder (604) of third chamber (600), according to an embodiment herein.
Figure 2:
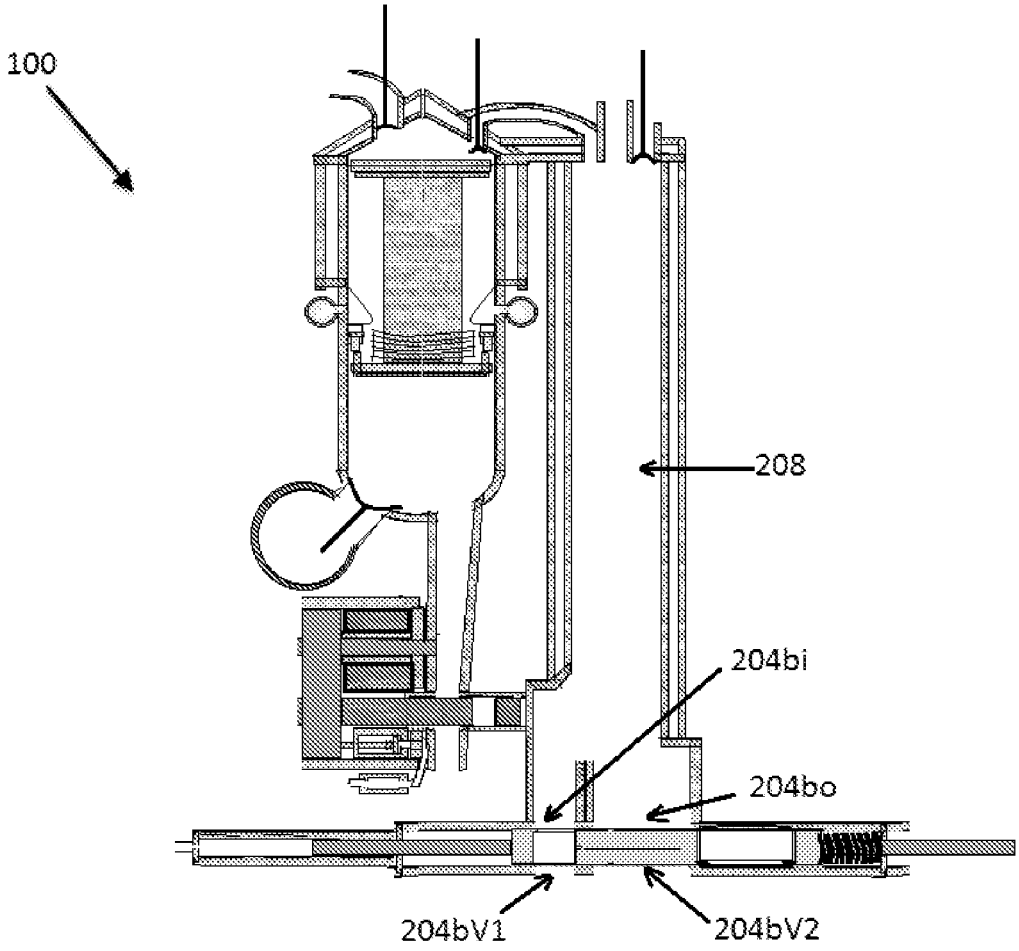
FIG. 2 illustrates a schematic view of an internal combustion engine (100) with the first locking mechanism (800) of FIG. 1B coupled to the pipe (610) or the nozzle (610), according to an embodiment herein.
Figure 3:
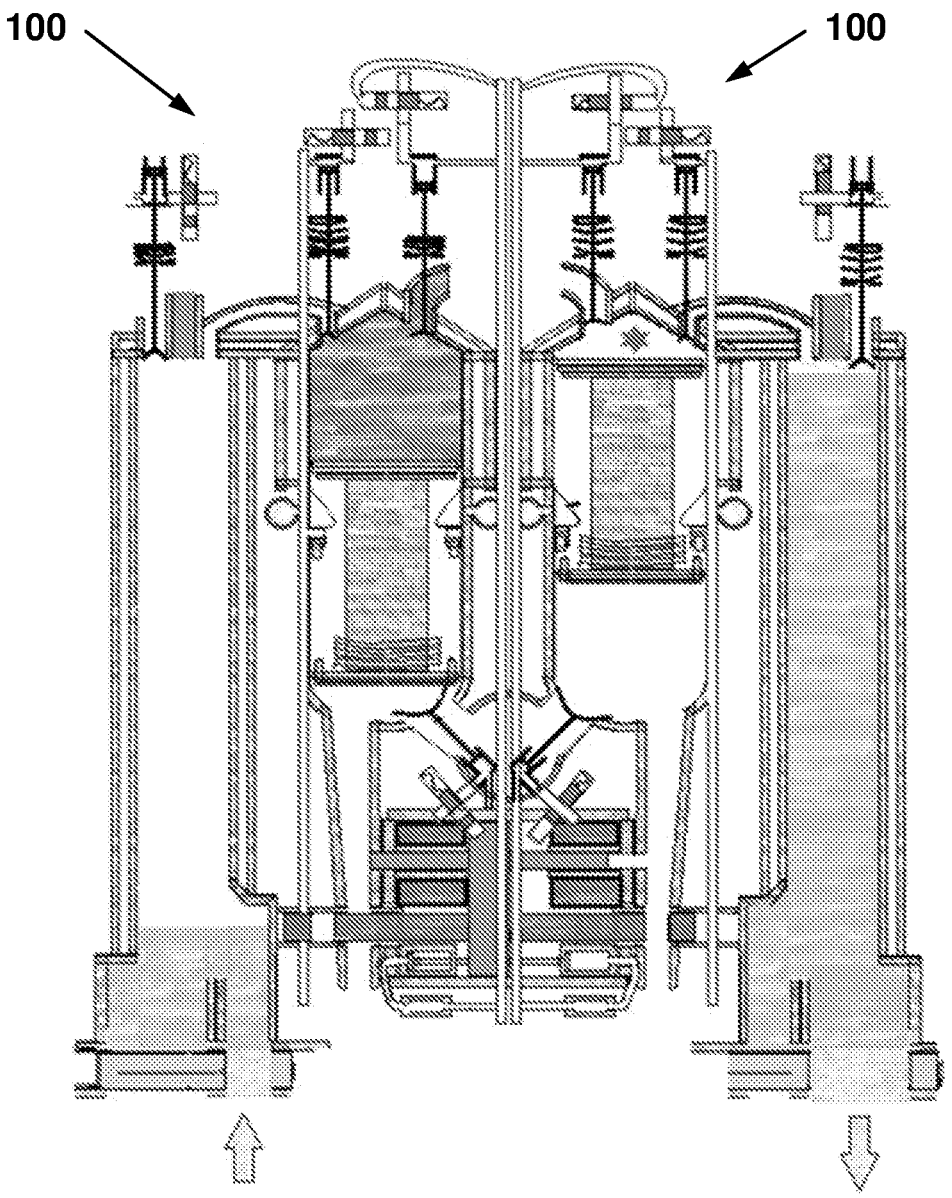
FIG. 3 illustrates a schematic view of a configuration, wherein two internal combustion engines of FIG. 1 are paired, according to an embodiment herein.
Figure 4:
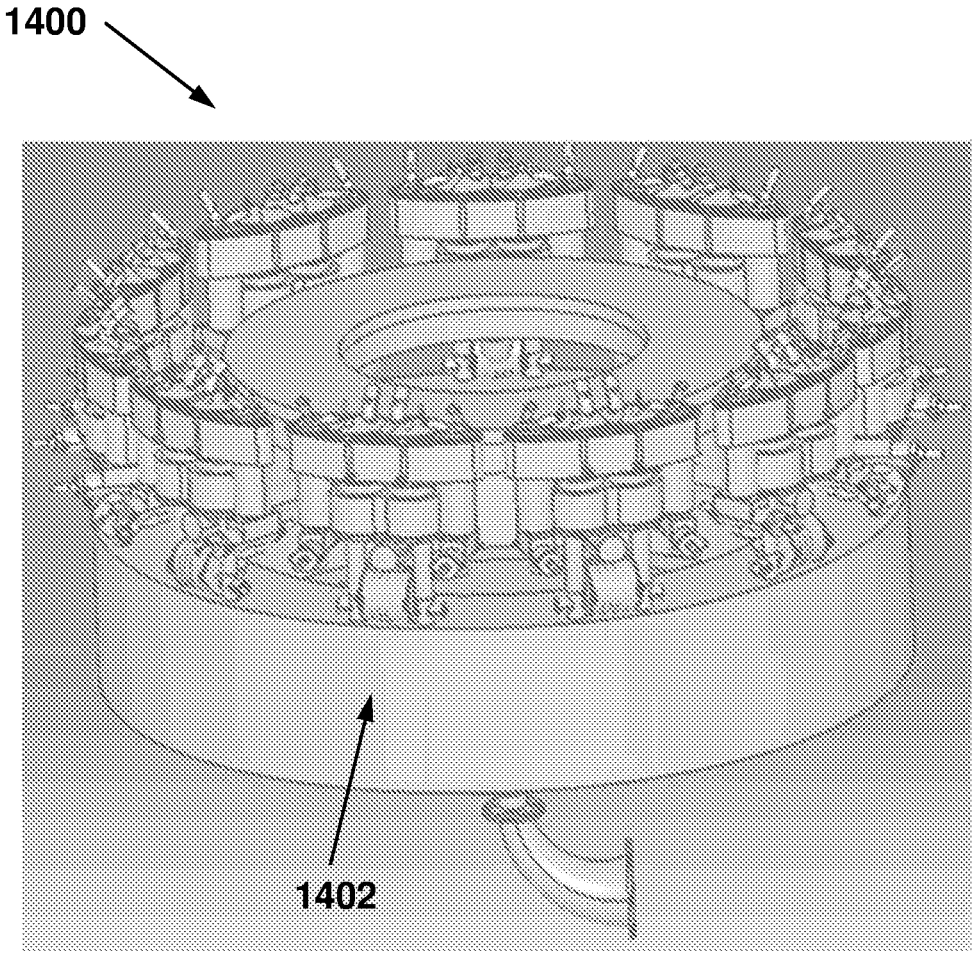
FIG. 4 illustrates a schematic view of a configuration, wherein several internal combustion engines of FIG. 1 are coupled, according to an embodiment herein.

The present invention is described with reference to the drawings, wherein FIG. 1A illustrates a schematic view of an internal combustion engine (100) in accordance with the embodiments of the present invention, FIG. 1B illustrates a schematic view of a second locking mechanism (1000) configured to selectively lock the movement of an elongated element (606) connecting a second piston (402) of a second chamber (400) and the third piston (602) of the third chamber (600), FIG. 1C illustrates a schematic view of a rack and pinion mechanism (1200) disposed operatively above a first cylinder head (206) and a second cylinder head (406), FIG. 1D illustrates a schematic view of a first locking mechanism (800), FIG. 1E illustrates a schematic view of a fluid pump (812) and a fluid pump (814) in the first locking mechanism (800), FIG. 1F illustrates a schematic view of a first locking mechanism (800) connected to a pipe (610) or a nozzle (610) emerging from the third chamber (600) of the internal combustion engine (100), FIG. 1G illustrates schematic view of fluid pump (616) in a third cylinder (604) of third chamber (600), FIG. 2 illustrates a schematic view of an internal combustion engine (100) with incompressible liquid used as pumping means and the first locking mechanism (800) of FIG. 1D coupled to the pipe (610) or the nozzle (610), FIG. 3 illustrates a schematic view of a configuration, wherein two internal combustion engines of FIG. 1 are paired; and FIG. 4 illustrates a schematic view of a configuration, wherein several internal combustion engines of FIG. 1/FIG. 2/FIG. 3 are coupled.

Referring to FIG. 1A, in accordance with an embodiment of the present invention, the internal combustion engine (100) comprises a first chamber (200) having a pumping means (202) disposed therein, wherein the first chamber (200) is configured to pump air or a charge, a second chamber (400) having a second piston (402) disposed therein, the first chamber (200) is connected to and in fluid communication with the second chamber (400) and configured to receive the air or charge from the first chamber (200) or from a source of compressed air thereof selected from the group consisting of compressors or pre-compressed air, a third chamber (600) having third piston (602) disposed therein, the third chamber (600) is configured to receive a fluid therein and the third piston (602) operatively coupled to the second piston (402) and a first locking mechanism (800) applied on a pipe (610) or a nozzle (610) on the third chamber (600) wherein the first locking mechanism (800) is configured to lock the movement of the third piston (602) by selectively allowing the flow out of the fluid from the third chamber (600) or a second locking mechanism (1000) configured to lock the movement of an elongated element (606) and thereby restrict the movement of the second piston (402) or both the first locking mechanism (800) applied on a pipe (610) or a nozzle (610) and second locking mechanism (1000) configured to lock the movement of an elongated element (606).

In accordance with an embodiment of invention, the first chamber (200) comprises a first cylinder (204) having a first operative end (204*a*) and a second operative end (204*b*) and a first cylinder head (206) sealably disposed on the first operative end (204*a*) of the first cylinder (204). The pumping means (202) is reciprocally disposed within the first cylinder (204) configured to move slidably and reciprocally to and from the first operative end (204*a*) and the second operative end (204*b*) of the first cylinder (204). A first space (208) is defined by the walls of the first cylinder (204), the first cylinder head (206), and the pumping means (202) for receiving air from the atmosphere.

In accordance with the present invention the first chamber (200) can be optionally provided with a fuel injector, to add fuel to the air drawn from atmosphere to form air fuel mixture or the charge.

In accordance with the present invention, the first cylinder (204) can be optionally provided with a cooling jacket (204*c*) disposed on an outer operative surface (2042) thereof for circulating a cooling fluid therethrough.

The first cylinder head (206) includes a first inlet port (206*b*) configured thereon to draw air therethrough from the atmosphere or a source thereof, a first inlet valve (206*c*) operably received within the first inlet port (206*b*), a first outlet port (206*d*) configured on the first cylinder head (206) to eject air or charge therethrough to the second chamber (400), and In accordance with an embodiment of the present invention, the first cylinder head (206) can be optionally provided with a cooling jacket (206*a*) disposed on an outer operative surface thereof for circulating a cooling fluid therethrough.

In an embodiment, a single cooling jacket may also be provided instead of two separate cooling jackets. The flow rate of the cooling fluid can be optimized to suitably remove the heat generated during the operation. The cooling fluid can be introduced in to the cooling jackets employing a suitable pump. The temperature of the cooling fluid can be cooled to the desired temperature by known means such as using water cooling technique or compressor or combination thereof.

The cooling fluid can be at least one fluid selected from a gas, a liquid and a combination thereof. The gas can be at least one selected from the group consisting of helium, air, nitrogen and a combination thereof. The liquid can be at least one selected from the group consisting of water, alcohol, oil and a combination thereof.

In addition to the above-mentioned components, the first cylinder head (206) can, in accordance with an embodiment of the present invention, further include a cylindrical barrel (206*e*) having a first end (206*e*1) and a second end (206*e*2), the second open end (206*e*2) opening in the first space (208). The cylindrical barrel (206*e*) extends operatively upward from the first cylinder head (206).

In accordance with an embodiment of the present invention, the pumping means (202) is a first piston having a first operative surface (202*a*) and a second operative surface (202*b*). An elongated element (202*c*) is secured to the piston passing through trough. A first portion (202*c*1) of the elongated element (202*c*) is disposed above the first operative surface (202*a*) and a second portion (202*c*2) of the elongated element (202*c*) is disposed below the second operative surface (202*b*). The first portion (202*c*1) of the elongated element (202*c*) is received within the cylindrical barrel (206*e*) when the first piston (202) moves operatively upwards towards the first cylinder head (206).

Referring to FIG. 2, an incompressible liquid is used in place of first piston as pumping means (202) wherein second operative end (204*b*) of the first cylinder (204) is closed and the first cylinder head (206), the first cylinder (204) and the closed second operative end (204*b*) define the first space (208), according to an embodiment. The closed second operative end (204*b*) includes a second inlet port (204*bi*) configured thereon to fill incompressible liquid into first chamber (200) to pump or push air or charge into second chamber (400), a second inlet valve (204*b*V1) is received in second inlet port (204*bi*), a second outlet port (204*bo*) configured to remove incompressible liquid from the first chamber (200) to draw in air from the atmosphere through the first inlet port (206*b*), a second outlet valve (204*b*V2) is received in second outlet port (204*bo*). A sensor is placed in the first cylinder head (206) to detect the level of the incompressible liquid filled in the first chamber (200).

Further, the second chamber (400) comprises a second cylinder (404) having a first operative end (404*a*) and a second operative end (404*b*), and a second cylinder head (406) sealably disposed on the first operative end (404*a*) of the second cylinder (404); the second piston (402) is reciprocally disposed within the second cylinder (404) configured to move slidably and reciprocally to and from the first operative end (404*a*) and the second operative end (404*b*) of the second cylinder (404).

In accordance with the present invention, the second cylinder head (406), walls of the second cylinder (404) of the second chamber (400) and the second piston (402) define a second space (408) therewithin for receiving the air or charge from the first chamber (200) or from a source of compressed air thereof selected from the group consisting of compressors or pre-compressed air.

The second cylinder head (406) comprises a third inlet port (406*b*) configured on the second cylinder head (406) to receive the air or the charge from the first chamber (200) via the first outlet port (206*d*) of the first chamber (200) or from a source of compressed air thereof, the third inlet port (406*b*) adapted to receive a third inlet valve (406*c*) therein, a third outlet port (406*d*) configured on the second cylinder head (406) to eject a combustion product therethrough to the atmosphere, the third outlet port (406*d*) adapted to receive a third outlet valve (406*e*) therein.

In accordance with the present invention the Second chamber (400) can be optionally provided with a fuel injector, to add fuel to the air received from the first chamber (200) to form air fuel mixture or the charge or to bring about compression ignition.

The second cylinder (404) is optionally provided with a cooling jacket (404*c*) disposed on an outer operative surface (4042) thereof and the second cylinder head (406) is optionally provided with a cooling jacket (406*a*) disposed on an outer operative surface (4062) thereof. A cooling fluid is passed through the cooling jackets (404*c*, 406*a*). The cooling fluid can be at least one fluid selected from a gas, a liquid and a combination thereof. The gas can be at least one selected from the group consisting of helium, air, nitrogen and a combination thereof. The liquid can be at least one selected from the group consisting of water, alcohol, oil and a combination thereof.

In an embodiment, a single cooling jacket may also be provided instead of two separate cooling jackets. The flow rate of the cooling fluid can be optimized to suitably remove the heat generated during the operation. The cooling fluid can be introduced in to the cooling jackets employing a suitable pump. The temperature of the cooling fluid can be cooled to the desired temperature by known means such as using water cooling technique or compressor or combination thereof.

The third chamber (600) comprises a third cylinder (604) having an open first operative end (604*a*), and a closed second operative end (604*b*); the third piston (602) is reciprocally disposed within the third cylinder (604) configured to move slidably and reciprocally to and from the open first operative end (604*a*) and the closed second operative end (604*b*) of the third cylinder (604).

In accordance with the present invention, the closed second operative end (604*b*), walls of the third cylinder (604) of the third chamber (600) and the third piston (602) define a third space (608) therewithin for receiving a fluid therein.

The closed second operative end (604*b*) includes a pipe (610) or a nozzle (610) configured thereon. In particular, the pipe (610) or the nozzle (610) is configured on the closed second operative end (604*b*) of the third cylinder (604) of the third chamber (600) on one side thereof as shown in the figures/drawings. The pipe (610) or the nozzle (610) is configured to selectively facilitate pumping out of a fluid from the third chamber (600). In particular, when the third piston (602) moves downward towards the closed second operative end (604*b*) during the operation, the fluid contained in the third space (608) is forced out of the third chamber (600) through the pipe (610) or the nozzle (610).

In an embodiment of the present invention, a fourth inlet port (612) is configured on the closed second operative end (604*b*) of the third cylinder (604) of the third chamber (600). The fourth port (612) is adapted to receive fluid from a fluid source and facilitate passage of the fluid into the third chamber (600) from the fluid source and have a fourth inlet valve (614) operably disposed therein. The fluid can be pumped into the third chamber (600) using a pump.

Referring to FIG. 1G, according to an embodiment of present invention, at least one fluid pump (616) is operatively disposed within the third cylinder (604) extending from the wall of the cylinder substantially close to the open first operative end (604*a*) of the third cylinder (604). The fluid pump (616) comprises a cylindrical chamber (616*a*) closed on both ends having a first operative end (616*a*1)

facing the closed second operative end (604*b*) of the third cylinder (604) and a second operative end (616*a*2) towards the open first operative end (604*a*) of the cylindrical chamber (616*a*). A first opening (616*c*) to the cylindrical chamber (616*a*) is provided in the first operative end (616*a*1). A second opening (616*d*1) and a third opening (616*d*2) are provided to the cylindrical chamber (616*a*) in the second operative end (616*a*2). The second opening (616*d*1) receives an outlet valve through which fluid is ejected from the cylindrical chamber (616*a*) and the third opening (616*d*2) receive a inlet valve through which fluid is received into the cylindrical chamber (616*a*). A piston (616*b*) having a first operative surface (616*b*1) and a second operative surface (616*b*2) is reciprocally disposed within the cylindrical chamber (616*a*). The piston slideably moves from and to the first operative end (616*a*1) of the cylindrical chamber. The second operative surface (616*b*2) of the piston (616*b*) faces the first operative end (616*a*1) of the cylindrical chamber. An elongated element (616*b*E) is secured to the second operative surface (616*b*2) of the piston (616*b*). The elongated element (616*b*E) emerges out of the cylindrical chamber (616*a*) through the first opening (616*c*). A resilient member/spring is attached to the free end of the elongated element (616*b*E). The elongated element (616*b*E) comes in contact with the face of third piston (602) towards the open first operative end (604*a*1) of the cylindrical chamber (616*a*) and the elongated element (616*b*E) along with piston (616*b*) is pushed by the third piston (602) towards second operative end pushing out the fluid in the cylindrical chamber (616*a*). The third piston (602) is detached from the contact of the elongated element (616*b*E), as it moves towards the closed second operative end (604*b*) in power stroke and the elongated element (616*b*E) along with piston (616*b*) is pulled towards the first operative end (616*a*1) of the cylindrical chamber (616*a*) drawing in fluid through the third opening (616*d*2) into the cylindrical chamber (616*a*).

In accordance with the present invention, the third cylinder (604) is disposed operatively next to the second chamber (400), wherein the second operative end (404*b*) of the second cylinder (404) of the second chamber (400) faces the open first operative end (604*a*) of the third cylinder (604) of the third chamber (600) aiding in operatively connecting the second piston (402) to the third piston (602). The second piston (402) and the third piston (602) are coupled together by an elongated element (606).

In an embodiment of the invention, the second cylinder (404) and third cylinder (604) are joined by joining the second operative end (404*b*) of the second cylinder (404) of the second chamber (400) to the open first operative end (604*a*) of the third cylinder (604) of the third chamber (600) to make a single continuous cylinder housing the second chamber (400) and third chamber (600) and the second piston (402) and the third piston (602) are operatively coupled by an incompressible liquid filled in between.

According to an embodiment of the invention, the second cylinder (404) and third cylinder (604) are joined by joining the second operative end (404*b*) of the second cylinder (404) of the second chamber (400) to the open first operative end (604*a*) of the third cylinder (604) of the third chamber (600) to make a single continuous cylinder. The second piston (402), the third piston (602) and the elongated element (606) are replaced with an incompressible liquid which is directly subjected to the gas force due to high pressure hot combustion product and ejected through the pipe (610) or the nozzle (610).

In accordance with the present invention, the pipe (610) or the nozzle (610) is provided with a first locking mechanism (800). The first locking mechanism (800) is configured to selectively allow the passage of the fluid from the third chamber (600) to a utility such as a turbine which is coupled to a dynamo or an alternator.

Referring to FIG. 1D, in accordance with an embodiment of present invention, the first locking mechanism (800) comprises a housing (802) having a cylinder (802*a*), wherein the cylinder (802*a*) having first operative end (802*a*1) and second operative end (802*a*2), a first end plate (802*b*) having first operative surface (802*b*1) and second operative surface (802*b*2) is disposed sealably on second operative end (802*a*2) of the cylinder (802*a*) and a second end plate (802*c*) having first operative surface (802*c*1) and second operative surface (802*c*2) is disposed sealably on first operative end (802*a*2) of the cylinder (802*a*). The first end plate (802*b*) is having a first aperture (802*b*H1) and a second aperture (802*b*H2) spaced apart from first aperture (802*b*H1). The second end plate (802*c*) is having a first aperture (802*c*H1) and a second aperture (802*c*H2) spaced apart from first aperture (802*c*H1). The cylinder (802*a*), first end plate (802*b*) and second end plate (802*c*) define a space (808). The second operative surface (802*c*2) of second end plate (802*c*) is disposed facing the space (808) and the first operative surface (802*c*1) of second end plate (802*c*) is disposed out. The second operative surface (802*b*2) of first end plate (802*b*) is disposed facing the space (808) and the first operative surface (802*b*1) of first end plate (802*b*) is disposed out. A first tubular member (806) is attached to the first aperture (802*c*H1) on the second operative surface (802*c*2) of the second end plate (802*c*) and disposed extended into space (808) and a first magnet (802*c*M) is attached to the second operative surface (802*c*2) of the second end plate (802*c*) abutting the first tubular member (806). A second tubular member (807) is attached to the first aperture (802*b*H1) on the second operative surface (802*b*2) of the first end plate (802*b*) and disposed extended into space (808) and a second magnet (802*b*M) is attached to the second operative surface (802*b*1) of first end plate (802*b*) abutting the second tubular member (807). A third tubular member (810) is attached to the second aperture (802*c*H2) on the first operative surface (802*c*1) of the second end plate (802*c*) and disposed extended to outside. A through-hole (810*h*) is provided in the third tubular member (810). A fourth tubular member (811) is attached to the second aperture (802*b*H2) on the first operative surface (802*b*1) of the first end plate (802*b*) and disposed extended to outside. A through-hole (811*h*) is provided in the third tubular member (811).

In accordance with an embodiment of the present invention, in the space (808), a substantially cylindrical chunk (804) having a first operative surface (804*a*1) and a second operative surface (804*a*2) is reciprocally disposed. The substantially cylindrical chunk (804) is configured to move slideably and reciprocally to and from the first operative end (802*a*1) and the second operative end (802*a*2) of the cylinder (802*a*). The substantial cylindrical chunk (804) is made of metals from group of metals like iron, cobalt, nickel etc which are attracted by magnets. A first elongated bar (806*a*) having a first end (806*a*1) and a second end (806*a*2) is disposed attached to first surface (804*a*1) of substantially cylindrical chunk (804), with the second end (806*a*2) and the first end (806*a*1) of the first elongated bar (806*a*) is displaceably received in first tubular member (806). A second elongated bar (807*a*) having a first end (807*a*1) and a second end (807*a*2) is disposed attached to second surface (804*a*2) of substantially cylindrical chunk (804) with the second end (807*a*2) and the first end (807*a*1) of the first elongated bar (807*a*) is displaceably received in first tubular member (807). A third elongated bar (810*a*) having a first end (810*a*1) and a second end (810*a*2) is disposed attached to first surface (804*a*1) of substantially cylindrical chunk (804) with the second end (810*a*2), spaced apart from first elongated bar (806*a*) and the first end (810*a*1) of the third elongated bar (810*a*) is displaceably received in third tubular member (810). A hole (810*ah*) is provided in the third elongated bar substantially close to the first end (810*a*1). A fourth elongated bar (811*a*) having a first end (811*a*1) and a second end (811*a*2) is disposed attached to second surface (804*a*2) of substantially cylindrical chunk (804) with the second end (811*a*2), spaced apart from first elongated bar (807*a*) and the first end (811*a*1) of the third elongated bar (811*a*) is displaceably received in third tubular member (811). A hole (811*ah*) is provided in the third elongated bar substantially close to the first end (811*a*1).

In accordance with the present invention, referring to FIG. 1E, at least one fluid pump (812) is operatively disposed in space (808), wherein the fluid pump (812) comprise a closed cylindrical chamber (812*a*) having a first operative end (812*a*1) attached to the second operative surface (802*c*2) of second end plate (802*c*) and a second operative end (812*a*2) extended into space (808) facing the first operative surface (804*a*1) of substantially cylindrical chunk (804). A first opening (812*c*) is provided to the cylindrical chamber in the wall on the second operative end (812*a*2) facing the first operative surface (804*a*1) of substantially cylindrical chunk (804). A second opening (812*d*1) and a third opening (812*d*2) are provided to the cylindrical chamber in the first operative end (812*a*1). The second opening (812*d*1) receive a outlet valve through which fluid is ejected from the closed cylindrical chamber (812*a*) and the third opening (812*d*2) receive a inlet valve through which fluid is received into the cylindrical chamber (812*a*). A piston (812*b*) is reciprocally disposed within the cylindrical chamber (812*a*) configured to move slideably and reciprocally to and from the first operative end (812*a*1) and the second operative end (812*a*2) of the cylindrical chamber (812*a*). A connecting rod (812*br*) is configured configure with a first end (812*br*1) connected to the piston (812*b*) and a second end (812*br*2) connected to the first operative surface (804*a*1) of substantially cylindrical chunk (804) passing through the first opening (812*c*), wherein the displacement of substantially cylindrical chunk (804) away from the second end plate (802*c*) displace the piston (812*b*) drawing in fluid through second opening (812*d*1) into the cylindrical chamber (812*a*) and the displacement of substantially cylindrical chunk (804) towards the second end plate (802*c*) displace the piston (812*b*) pumping out fluid through third opening (812*d*2) from the cylindrical chamber (812*a*).

In accordance with the present invention, referring to FIG. 1E, at least one fluid pump (814) is operatively disposed in space (808), wherein the fluid pump (814) comprise a closed cylindrical chamber (814*a*) having a first operative end (814*a*1) attached to the second operative surface (802*b*2) of first end plate (802*b*) and a second operative end (814*a*2) extended into space (808) facing the second operative surface (804*a*2) of substantially cylindrical chunk (804). A first opening (814*c*) is provided to the cylindrical chamber in the wall on the second operative end (814*a*2) facing the second operative surface (804*a*2) of substantially cylindrical chunk (804). A second opening (814*d*1) and a third opening (814*d*2) are provided to the cylindrical chamber in the first operative end (814*a*1). The second opening (814*d*1) receive a outlet valve through which fluid is ejected from the cylindrical chamber (814*a*) and the third opening (814*d*2) receive a inlet valve through which fluid is received into the cylindrical chamber (814*a*). A piston (814*b*) is reciprocally disposed within the cylindrical chamber (814*a*) configured to move slideably and reciprocally to and from the first operative end (814*a*1) and the second operative end (814*a*2) of the cylindrical chamber (814*a*). A connecting rod (814*br*) is configured configure with a first end (814*br*1) connected to the piston (814*b*) and a second end (814*br*2) connected to the second operative surface (804*a*2) of substantially cylindrical chunk (804) passing through the first opening (814*c*), wherein the displacement of substantially cylindrical chunk (804) away from the first end plate (802*b*) displace the piston (814*b*) drawing in fluid through second opening (814*d*1) into the cylindrical chamber (814*a*) and the displacement of substantially cylindrical chunk (804) towards the first end plate (802*b*) displace the piston (814*b*) pumping out fluid through third opening (814*d*2) from the cylindrical chamber (814*a*).

In accordance with the invention, Referring to FIG. 1F, the first operative surface (802*c*1) of the second end plate (802*c*) is connected to the wall of pipe (610) or nozzle (610) such that a first aperture (610*ap*) configured in the wall of pipe (610) or nozzle (610) register with first aperture (802*c*H1) and the first aperture (610*ap*) in the wall of pipe (610) or nozzle, the first aperture (802*c*H1) in the second end plate (802*c*) and the first tubular member (806) on the second end plate (802*c*) make a watertight passage wherein the first elongated bar (806*a*) is received reciprocally disposed. A through hole (610H) is configured in the wall of pipe (610) or nozzle (610) wherein the third tubular member (810) on the second end plate (802*c*) enters such that the through hole (810*h*) register in line with the cavity of the pipe or the nozzle allowing flow of fluid. In the locked configuration, the first elongated bar (806*a*) extends into the pipe or the nozzle through the first aperture (610*ap*) till the first end (806*a*1) of the first elongated bar (806*a*) reach the inner surface of the pipe wall or the nozzle wall and the third elongated bar (810*a*) move in the third tubular member (810) blocking the hole (810*h*) stopping the flow of fluid. The substantially cylindrical chunk (804) come in contact with first magnet (802*c*M) and held attracted by the magnetic pull which act as resistance against the pressure in third chamber (600). When the pressure in the fluid in the third chamber (600) increase beyond a critical pressure, the force on the first end (806*a*1) of the first elongated bar (806*a*) exceed the magnetic pull on the substantially cylindrical chunk (804) due to first magnet (802*c*M) and push the substantially cylindrical chunk (804) away from the second end plate (802*c*), the third elongated bar (810*a*) is pulled out thereby bringing the hole (810*ah*) in line with the hole (810*h*) and the lock attain unlocked configuration allowing the flow out of fluid. The substantially cylindrical chunk is pushed towards the second end plate (802*c*) applying external force to bring the lock to the locked configuration.

In accordance with an embodiment of the invention, referring to FIG. 1F and FIG. 3, the first locking mechanism (800) connected to one pipe or nozzle on the second end plate (802*c*) is optionally connected to a second pipe or nozzle on the first end plate (802*b*) thereby allowing a pair of internal combustion engines (100) to share the first locking mechanism (800), wherein the second pipe (610) or nozzle (610) is connected to the first operative surface (802*b*1) such that a first aperture (610*ap*) configured in the wall of second pipe or nozzle register with first aperture (802*b*H1) and the first aperture (610*ap*) in the wall of second pipe or nozzle, the first aperture (802*b*H1) in the first end plate (802*b*) and the second tubular member (807) on the first end plate (802*b*) make a watertight passage wherein the second elongated bar (807*a*) is received reciprocally disposed. A through hole (610H) is configured in the wall of second pipe or nozzle wherein the fourth tubular member (811) on the first end plate (802*b*) enters such that the through hole (811*h*) register in line with the cavity of the nozzle allowing flow of fluid. In the locked configuration, the second elongated bar (807*a*) extends into the pipe or the nozzle through the first aperture (610*ap*) till the first end (807*a*1) of the second elongated bar (807*a*) reach the inner surface of the second pipe wall or nozzle wall and the fourth elongated bar (811*a*) move in the fourth tubular member (811) blocking the hole (811*h*) stopping the flow of fluid. The substantially cylindrical chunk (804) come in contact with second magnet (802*b*M) and held attracted by the magnetic pull which act as resistance against the pressure in the third chamber (600). When the pressure in the fluid in the third chamber (600) increase beyond a critical pressure, the force on the first end (807*a*1) of the first elongated bar (807*a*) exceed the magnetic pull on the substantially cylindrical chunk (804) and push the substantially cylindrical chunk (804) away from the first end plate (802*b*), the fourth elongated bar (811*a*) is pulled out thereby bringing the hole (811*ah*) in line with the hole (811*h*) and the lock attain unlocked configuration allowing the flow out of fluid. When the second pipe or nozzle connected on the first end plate (802*b*) is unlocked for flow out of fluid therethrough, the pipe or the nozzle connected on the second end plate (802*c*) is locked blocking the flow of fluid therethrough. When the pipe or the nozzle connected to the second end plate (802*c*) is unlocked the substantially cylindrical chunk (804) is pushed away from the second end plate (802*c*) towards the first end plate (802*b*) locking the second pipe or nozzle connected to the first end plate (802*b*).

Further, a second locking mechanism (1000) (referring to FIG. 1A in combination with FIG. 1B) is configured to selectively lock the movement of the elongated element (606) and hence arrest the movement of the second piston (402) and the third piston (602). The second locking mechanism (1000) comprises at least one wedge shaped shoe (1002) having a first edge (1002*a*), a second edge (1002*b*), and a third edge (1002*c*). The at least one wedge shaped shoe (1002) is pivotally secured at the first edge (1002*a*) thereof, to a support (1012) extending from inner walls of the second cylinder (404) of the second chamber (400), and is pivotally connected to a first end (1006*a*) of a connecting rod (1006) at the second edge (1002*b*) thereof, a second end (1006*b*) of the connecting rod is pivotally connected to a piston (1008), the piston (1008) being reciprocally received in a cylinder (1010) with a pressure relief valve (1010*a*) configured thereon, a groove (1004) configured on the elongated element (606), the groove having a shape complimentary to the shape of the third edge (1002*c*) of the shoe (1002), the groove (1004) is configured to receive the third edge (1002*c*) of the at least one wedge shaped shoe (1002) therein in a locking mode, wherein the cylinder (1010) receives a pressurized fluid therein, thereby displacing the piston (1008), which in turn displaces the connecting rod (1006), which displaces the second edge (1002*b*), thereby rotating the at least one wedge shaped shoe (1002) around the first edge (1002*a*) thereof in anti-clockwise direction, and the groove (1004) receives the third edge (1002*c*) therein, thereby locking the movement of the elongated element (606) and hence arrest the movement of the second piston (402) and third piston (602), and wherein in a non-locking mode, the pressurized fluid is drawn out/pushed out of the cylinder (1010), displacing the piston (1008) towards in the cylinder (1010), which in turn displaces the connecting rod (1006), which displaces the second edge (1002*b*) towards the support (1012), thereby rotating the at least one wedge shaped shoe (1002) around the first edge (1002*a*) thereof in clockwise direction, and the third edge (1002*c*) is displaced away from the groove (1004), thereby unlocking the elongated element (606) and hence facilitating the movement of the second piston (402) and third piston (602).

A rack and pinion mechanism (1200) (referring to FIG. 1 in combination with FIG. 1C) is disposed operatively above the first cylinder head (206) and the second cylinder head (406). The rack and pinion mechanism (1200) comprises a rack (1202), a pinion (1204) meshing with the rack (1202), the pinion (1204) rotatably disposed on a support, and a cam (1206) meshing with the pinion (1204), rotatably disposed on a support, the cam (1206) is coupled to the third inlet valve (406*c*), wherein the rack (1202) having a first end (1202*a*) and a second end (1202*b*), the first end (1202*a*) and a portion of the rack (1202) protrudes in to the first space (208) through an aperture first cylinder head (206), in a sealable manner; and the second end (1202*b*) coupled to a resilient member (1208), wherein the first piston (202) abuts the first end (1202*a*), in a cycle to pump out the air or charge from the first chamber (200), the first piston (202) pushes the first end (1202*a*) thereby pushing the portion of the rack (1202) out of the first chamber (200) and compressing the resilient member (1208), and wherein the pinion (1204) is rotated which in turn rotates the cam (1206) moving it off from the third inlet valve (406*c*), wherein the cam (1206) is coupled to the third inlet valve (406*c*) such that the cam holds the third inlet valve (406*c*) open during the transfer of air or charge into the second chamber (400) from the first chamber (200) and when the cam (1206) is moved off from the third inlet valve (406*c*), the valve is allowed to close by the restoring forces of valve spring or pressure in second chamber (400).

In accordance with an embodiment, a hydraulic valve system comprising at least one fluid pump (616) in third chamber (600), at least one fluid pump (812) in the lock mechanism (800) and at least one fluid pump (814) in the lock mechanism (800) actuates the valves in first inlet port (206*b*), second inlet port (204*bi*), third inlet port (406*b*), second outlet port (204*bo*), third outlet port (406*d*) and fourth inlet port (612). The fluid pumps in hydraulic valve system are connected to the valve in the inlet and outlet ports through conduits to carry fluid and directional valves regulating the flow.

In accordance with an embodiment of the invention, the first chamber (200) is an air or charge injector, the second chamber (400) is a combustion chamber, and the third chamber (600) is an ejector.

FIG. 4 illustrates a schematic view of a configuration, wherein several internal combustion engines of FIG. 1/FIG. 2/FIG. 3 are suitably coupled to achieve an electric power generator, wherein the internal combustion engine (100) is configured to eject the liquid like water in the third chamber (600) into a funnel shaped container (1402) having a broad end and a narrow end. The internal combustion engines are coupled to the funnel shaped container on broad end and liquid is allowed to flow out from the narrow end of the funnel shaped container through an opening operatively coupled to a turbine which in turn runs a dynamo or an alternator. In accordance with an aspect of the present invention, an electric power generating system is disclosed, wherein the system comprises the at least one internal combustion engine as described herein above, a turbine, operatively coupled to the at least one internal combustion engine, to receive driving force therefrom, and an electric power producing equipment selected from the group consisting of dynamo, and alternator, operatively coupled to the turbine to generate power.

Further, in accordance with an embodiment of the present invention, a control unit is provided, which is suitably coupled with the electric generator of FIG. 4 and the internal combustion engines therein, wherein the control unit comprises:

a processor;

a memory cooperating with the processor;

a monitoring module in communication with the processor;

an electronic control unit in communication with the processor and the monitoring module;

a display unit communicating with the processor; and a user input interface communicating with the processor.

The monitoring module comprises a plurality of sensors configured to monitor a plurality of parameters. The parameters include fluid level, valve position, and pressure inside the first, second and the third chambers. The electronic control unit is in communication with the processor and the monitoring module, wherein the electronic control unit is configured to receive the monitored parameters from the monitoring module and based on the parameters, the electronic control unit in combination with the processor is configured to generate one or more signals, which operate one or more valves, regulating the ignition sequence, regulating injection of fuel, regulate the flow of the fluids, and lock and unlock the pistons (second and third) etc.

In accordance with the present invention, the internal combustion engine (100) including the first chamber (200), the first cylinder (204), the first cylinder head (206), the first piston (202), and the elongated element (202*c*) can be made of any material that withstand the working temperatures and pressures, such as metal/alloy. The metals can be selected from the group consisting of iron, steel, aluminum and a combination thereof.

Working of the Internal Combustion Engine:

1. Working of the Engine of FIG. 1, FIG. 2 and FIG. 3:

The working of the internal combustion engine (100) is described herein below with reference to the FIG. 1 through FIG. 3.

At the time of ignition of the fuel or the charge in the second chamber (400), the third chamber (600) is filled with a fluid such as water and the fourth inlet port (612) or the fourth inlet valve (614) is in closed configuration. Further, the pipe (610) or the nozzle (610) is also closed. The first chamber (200) draws in air from atmosphere or a source of air and then the air or charge formed by mixing fuel into the air, is pumped into the second chamber (400). Thereafter, the third inlet port (406*b*) through which the air or the charge is transferred in to the second chamber (400) is closed. Also, the third outlet port (406*d*) is closed. The charge within the second chamber (400) is ignited therein.

In one embodiment, the ignition of the charge is brought about by employing a spark plug, wherein the spark plug (not shown in the figure) is controlled by the control unit.

In another embodiment, the ignition can be brought about by compression ignition, wherein the air is compressed and transferred to second chamber from the first chamber and fuel is injected directly into the compressed hot air in the second chamber (400), due to high temperature of air in second chamber the fuel is self-ignited.

In either case the heat addition due to combustion cause the pressure in second chamber (400) to increase. The second locking mechanism (1000) and the first locking mechanism (800) are employed to lock the second piston (402) and the third piston (602) in their place during the transfer of air or charge into the second chamber from the first chamber and the second locking mechanism (1000) is released on increase of the pressure over a predetermined level due to combustion of the fuel in the second chamber (400). The second locking mechanism (1000) is coupled with the control unit, wherein the control unit generates signals to lock or unlock the second locking mechanism (1000).

On unlocking the second locking mechanism (1000), the second piston (402) and hence the third piston (602) moves in power stroke rapidly away from the first operative end (404*a*) of the second cylinder (404) and the third piston (602) is pushed towards the closed second operative end (604*b*) of the third cylinder (604).

As the pressure exceeds a predetermined level in the third chamber (600), the force on the first end (806*a*1) of the first elongated bar (806*a*) due to pressure, increases more than the magnetic pull exerted by first magnet (802*c*M) on substantially cylindrical chunk (804), the first elongated bar (806*a*) is displaced pushing the substantially cylindrical chunk (804) away from second end plate (802*c*), which displaces the third elongated bar (810*a*) in the second tubular member (810), wherein the hole (810*ah*) registers in line with the through hole (810*h*) and the pipe (610) or the nozzle (610) thereby defining a passage through which the pressurized fluid or water passes out of the third chamber (600).

The second piston (402) reaches maximum expansion point allowed for the second chamber (400) or the third piston (602) reaches the maximum contraction point allowed for the third chamber (600), which marks the end of the power stroke. At this point the pipe (610) or the nozzle (610) is closed; the fourth inlet port (612) and the third outlet port (406*d*) are opened. The opening of the ports is brought about by using hydraulic actuation of the valves in the ports. The fluid or water (as the case may be) flows into the third chamber (600) through the fourth inlet port (612). As the fluid is filled in the third chamber (600), the third piston (602) is lifted in operative upward direction within the third chamber (600). As the third piston (602) moves away from the closed second operative end (604*b*), the second piston (402) is pushed towards the second cylinder head (406) thereby pushing the exhaust gases out of the second chamber (400) through the third outlet port (406*d*).

When the second chamber (400) is contracted to the minimum volume or the clearance volume, the third chamber (600) is filled with fluid or water to its full capacity and at this point the fourth inlet port (612) is closed. This point marks the end of the exhaust stroke. The third outlet port (406*d*) is closed, and the first inlet port (206*b*) in the first cylinder head (206) of the first chamber (200) is closed, and the air or the charge from the first chamber (200) is transferred to the second chamber (400), wherein the third inlet port (406*b*) is opened.

Parallel to the power stroke and the exhaust stroke in the second chamber (400), drawing of air takes place in the first chamber (200).

Working of the First Piston (202) as Pumping Means in First Chamber:

The first piston (202) is reciprocally disposed within the first chamber (200), wherein the first piston (202) is capable of moving reciprocally within the first cylinder (204). The first piston (202) is employed to compress the air or charge in the first chamber (200). When the first piston (202) moves away from the first cylinder head (206) from the first operative end (204*a*) to the second operative end (204*b*), the air is drawn in to the first chamber (200) through the first inlet port (206*b*). When the first piston (202) moves from the second operative end (204*b*) to the first operative end (204*a*) towards the first cylinder head (206) the air, or the charge formed by mixing fuel into the air, in the first chamber (200) is compressed and transferred to second chamber (400).

Further, throughout the power stroke and the exhaust stroke the movement of the rack (1202) and the pinion (1204) arrangement disposed on the first cylinder head (206) and the second cylinder head (406) is prevented from moving due to the obstruction posed by the valve arm to the cam (1206) in the rack (1202), the pinion (1204) and the cam (1206) mechanism.

On completion of the exhaust stroke, the third inlet valve (406*c*) in the third inlet port (406*b*) is actuated to open by a hydraulic valve actuation system. As the third inlet valve (406*c*) is moved, the obstruction to the cam (1206) is removed. The rack (1202) is pushed to move due to the restoration forces in the compressed spring/resilient member (1208) attached to it and tip of the rack (1202) protrudes in to the first chamber (200). The movement of the rack (1202) drives the pinion (1204) to move the cam (1206), placing the cam (1206) in line with the valve arm to hold the third inlet valve (406*c*) open. The hydraulic pressure holding the third inlet valve (406*c*) open is released as it is not required any more.

The first inlet port (206*b*) through which air is drawn into first cylinder (204) is closed and the first piston (202) in the first chamber (200) is pushed towards the first cylinder head (206) to transfer the air or the charge into the second chamber (400). When the first piston (202) comes in contact with the protrusion of rack (1202) in the first space (208), the rack (1202) is pushed compressing the resilient member (1208) attached to it. The movement of the rack (1202) rotates the pinion (1204). The pinion (1204) drives the cam (1206) to move off from the valve arm. The pressure in the second chamber (400) and the restoring forces of the valve spring on third inlet valve (406*c*) move the third inlet valve (406*c*) to close the third inlet port (406*b*). The charge in the second chamber (400) is ignited. The first piston (202) is pushed away from the first cylinder head (206) to draw air into the first chamber (200) through the first inlet port (206*b*), either by a bounce back mechanism in cylindrical barrel (206*e*) viz., the gas spring compressed during the compression stroke or by hydraulic or mechanical actuation acting on first portion (202*c*1) of the elongated element (202*c*) attached to the first piston (202).

Working of First Chamber (200) Using an Incompressible Liquid as Means of Compression When an incompressible liquid is used as pumping means in the first chamber (200), the first inlet port (206*b*) through which air is drawn into the first chamber (200), is closed and incompressible liquid is filled in the first chamber (200) through the second inlet port (204*bi*) to replace the air or charge in the first chamber (200) by compressing and pushing the air or charge into the second chamber (400) through the third inlet port. The incompressible liquid when reaches a predetermined level/position in the first chamber which is detected by a sensor installed in the first cylinder head (206), the third inlet valve (406*c*) is closed thereby closing the third inlet port (406*b*) by the control unit. With the closing of the third inlet valve (406*c*), the second inlet valve (204*b*V1) is closed and first inlet port (206*b*) is opened. The second outlet valve (204*b*V2) is opened to remove the incompressible liquid from the first chamber (200), and as incompressible liquid is removed from the first chamber (200), air is filled in through the first inlet port (206*b*).

Working of the Second Locking Mechanism (1000) Applied on Elongated Element (606):

The second locking mechanism (1000) which is configured to lock the elongated element (606), which couples the second piston (402) and the third piston (602), is provided in the second chamber (400). The elongated element (606) is released thereby facilitating the movement of the second piston (402) and the third piston (602) when the pressure in the second chamber (400) exceeds a predetermined value.

More specifically, the ignition and combustion of the charge increase the pressure in the second chamber (400) above the predetermined value and the force on second piston (402) due to the pressure in second chamber (400) push the edge (1002*c*) of the wedge shaped shoe (1002), rotating the wedge shaped shoe. The wedge shaped shoe (1002) in turn pushes the piston (1008) thereby exerting a force on the hydraulic liquid in the cylinder (1010). When the pressure on the hydraulic liquid in the cylinder (1010) exceeds a predetermined value, the pressure relief valve (1010*a*) opens letting the hydraulic liquid in the cylinder (1010) to flow out of the cylinder (1010). This allows the piston (1008) to move in, resulting in the edge (1002*c*) of the wedge shaped shoe (1002) to slip from the groove (1004) configured on the elongated element (606). This releases the elongated element (606), which in turn permits the movement of the second piston (402) away from the second cylinder head (406) and in turn the third piston (602) is pushed towards the closed second operative end (604*b*).

In another method the increase in the pressure in second chamber due to ignition and combustion of charge is detected by a sensor and the hydraulic liquid is drawn out from the cylinder (1010). This allows the piston (1008) to move in, resulting in the edge (1002*c*) of the wedge shaped shoe (1002) to slip from the groove (1004) configured on the elongated element (606). This releases the elongated element (606), which in turn permits the movement of the second piston away from the second cylinder head (406) and the third piston (602) towards the closed second operative end (604*b*).

Working of the First Locking Mechanism (800) Configured on the Pipe (610) or the Nozzle (610):

The first locking mechanism (800) attached and/or coupled to the pipe (610) or the nozzle (610) is actuated by the pressure exerted on the first end (806*a*1) of the first elongated bar (806*a*), which is in direct contact with the liquid or fluid within the third chamber (600). The pressure of the liquid or the fluid in the third chamber (600) is increased due to the combustion of the charge or fuel in the second chamber (400), which displaces the second piston (402) and in turn pushing the third piston (602) towards the closed second operative end (604*b*) of the third cylinder (604), which exerts force on the liquid in the third chamber (600) increasing the pressure in the liquid. The pressure in the liquid exert force on first end (806*a*1) of the first elongated bar (806*a*), and when the force on the first end (806*a*1) increases more than the magnetic pull on the substantially cylindrical chunk (804) due to first magnet (802*c*M) which is acting as resistance against the pressure in third chamber (600), the first elongated bar (806*a*) is pushed out in the first tubular member (806), in turn the substantially cylindrical chunk (804) is pushed away from first magnet (802*c*M) or the second end plate (802*c*). Along with the substantially cylindrical chunk (804), the third elongated bar (810*a*) is also displaced such that the hole (810*ah*) come in line with the through hole (810*h*) and the pipe (610) or the nozzle (610), through which the liquid under pressure flow out from the third chamber (600).

When the combustion gases in the second chamber (400) expand to a maximum volume permissible, the power stroke ends, which results in the decrease in the pressure of the liquid in the third chamber (600), that in turn decrease the force on the first end (806*a*1) of the first elongated bar (806*a*), at this point the first substantially cylindrical chunk (804), the first elongated bar (806*a*), and the third elongated bar (810*a*) are pushed to the original position by employing an external force, which results in mismatch in the position of the hole (810*ah*) and the through hole (810*h*), thereby blocking the passage the flow of the liquid from the third chamber (600). The substantially cylindrical chunk (804) comes in contact with first magnet (802*c*M) and held by the magnetic pull which acts as a resistance against the pressure in third chamber (600).

(In reference with FIG. 1F and FIG. 3) When two engines are paired to share the first locking mechanism (800), there is no requirement to apply external force to move substantially cylindrical chunk (804) to close the pipe or the nozzle or to attain locked configuration because opening of pipe or nozzle connected to the second end plate (802*c*) of the first locking mechanism (800) closes the other pipe or nozzle connected to the oppositely placed the first end plate (802*b*) of the first locking mechanism (800).

Working of Fluid Pump (616):

The space (616*a*S) of fluid pump (616) is normally filled with the fluid and the piston (616*b*) is near to the first operative end (616*a*1) of the cylindrical chamber (616*a*). The third piston (602) moving up in exhaust stroke due to filling of liquid in the third chamber (600), come in contact with the free end of the elongated element (616*b*E) just before the conclusion of exhaust stroke. The elongated element (616*b*E) is pushed up and in turn the piston (616*b*) is pushed towards second operative end (616*a*2) expelling the fluid in the cylindrical chamber (616*a*) through the second opening (616*d*1). At the commencement of the power stroke the third piston (602) move towards closed second operative end of third chamber (600) and elongated element (616*b*E) is detached from the contact of the third piston (602). The restoring forces in resilient member or spring attached to elongated element (616*b*E) pull out the elongated element (616*b*E) from the cylindrical chamber (616*a*) moving the piston (616*b*) to first operative end (616*a*1) drawing in fluid into the cylindrical chamber (616*a*).

Working of Fluid Pump (812):

When the first locking mechanism (800) is in locked configuration with respect to pipe or nozzle connected to second end plate (802*c*) of the first locking mechanism (800), the piston (812*b*) is near to first operative end (812*a*1) of the cylindrical chamber (812*a*). As the substantially cylindrical chunk (804) is pushed away from the second end plate (802*c*) to open the pipe (610) or the nozzle (610), the piston (812*b*) move away from first operative end (812*a*1) of the cylindrical chamber (812*a*) drawing in fluid into the cylindrical chamber (812*a*) through second opening (812*d*1). When the substantially cylindrical chunk (804) is pushed towards the second end plate (802*c*) to close the pipe (610) or the nozzle (610), the piston (812*b*) move towards the first operative end (812*a*1) of the cylindrical chamber (812*a*) expelling the fluid out of the cylindrical chamber (812*a*) through the third opening (812*d*2).

Working of Fluid Pump (814):

When the first locking mechanism (800) is in locked configuration with respect to pipe or nozzle connected to first end plate (802*b*) of the first locking mechanism (800), the piston (814*b*) is near to first operative end (814*a*1) of the cylindrical chamber (814*a*). As the substantially cylindrical chunk (804) is pushed away from the first end plate (802*b*) to open the pipe (610) or the nozzle (610), the piston (814*b*) move away from first operative end (814*a*1) of the cylindrical chamber (814*a*) drawing in fluid into cylindrical chamber (814*a*) through second opening (814*d*1). When the substantially cylindrical chunk (804) is pushed towards the first end plate (802*b*) to close the pipe (610) or the nozzle (610), the piston (814*b*) move towards the first operative end (814*a*1) of the cylindrical chamber (814*a*) expelling the fluid out the cylindrical chamber (814*a*) through the third opening (814*d*2).

Working of Hydraulic Valve System in Internal Combustion Engine (100):

The hydraulic valve system includes at least one fluid pump (616) in third chamber (600), at least one fluid pump (812) in lock mechanism (800) and at least one fluid pump (814) in lock mechanism (800) connected to the valves in the first inlet port (206*b*), the second inlet port (204*bi*), the third inlet port (406*b*), the second outlet port (204*bo*), the third outlet port (406*d*) and the fourth inlet port (612) through conduits to carry fluid and directional valves regulating the flow.

The fluid pumps (812) and (814), pump out fluid during the closure of pipes or nozzles linked to them by lock mechanism (800). The fluid pumped by fluid pump (812) and (814), is mainly used to open third outlet port (406*d*) to push out exhaust gases and to open fourth inlet port (612) to fill the third chamber (600) in the engines connected to end plates (802*c*) and (802*b*) of the lock mechanism (800) respectively.

The fluid pump (616) pumps out fluid at the end of exhaust stroke. The fluid pumped by fluid pump (616) is mainly used to open third inlet port (406*b*) to transfer air or charge from first chamber (200) to second chamber (400).

Working of Electric Power Generator:

In accordance with the present invention, a system (1400) for generating electric power by running a turbine coupled to a device like alternator or dynamo to convert mechanical energy in the rotating turbine to electric energy or electromotive force is disclosed. The turbine is run by the fluid or water pumped by the internal combustion engines as disclosed herein. The individual internal combustion engines pump out water/liquid during the power stroke in the second chamber (400). The flow out of water/liquid during one power stroke in the internal combustion engine is referred to herein as a pulse. The water/liquid pumped out by the internal combustion engine is discharged into a funnel shaped container (1402). The internal combustion engines are arranged to operate in a sequence characterized by time gap of ignition and by the order of ignition. The engines are ignited one after the other in a set time gap to generate a continuous flow of water/liquid delivered into the funnel shaped container (1402). From the funnel shaped container (1402) the water/liquid is allowed to flow out with reasonably constant flow rate. The continuous and consolidated flow of water is engaged to run turbine.

TECHNICAL ADVANCES AND ADVANTAGES OF THE INVENTION

The presently disclosed invention, as described herein above, provides several advances including, but that are not limited to, an internal combustion engine, which:

Allows maximum expansion of hot gases during power stroke, thereby reducing or eliminating the heat loss in exhaust gases;

The split cylinder allows removal of heat produce during compression, through cooling jacket, thereby reducing the work in compression;

The free piston reduce the frictional losses;

is highly efficient, economical, simple and easy to operate, and easy to maintain.

I claim:

1. An internal combustion engine (100) comprising:

a first chamber (200) having a pumping means (202) disposed therein, wherein said first chamber (200) is configured to pump air or charge;

a second chamber (400) having a second piston (402) disposed therein, said second chamber (400) is connected to and in fluid communication with said first chamber (200) and said second chamber (400) is configured to receive air or charge from said first chamber (200) or from a source of compressed air thereof;

a third chamber (600) having a third piston (602) disposed therein, said third chamber provided with at least one fluid pump (616) configured to pump fluid to operate valves in the internal combustion engine (100), said third piston (602) operatively coupled to said second piston (402) and said third chamber (600) configured to receive a fluid therein and eject said fluid thereout;

a second locking mechanism (1000) configured to lock and unlock the movement of an elongated element (606) and thereby control the movement of said second piston (402) and/or a first locking mechanism (800) applied on a pipe (610) or a nozzle (610) on said third chamber (600), wherein at least one fluid pump (812, 814) configured to pump fluid to operate valves in the internal combustion engine (100 is provided in said first locking mechanism (800), wherein said first locking mechanism (800) is configured to control the movement of said third piston (602); and said second locking mechanism (1000) configured to selectively lock the movement of said elongated element (606) including:

at least one wedge shaped shoe (1002) having a first edge (1002*a*), a second edge (1002*b*), and a third edge (1002*c*);

a support (1012) extending from inner walls of said second cylinder (404) of said second chamber (400) on which said at least one wedge shaped shoe (1002) pivotally secured at the said first edge (1002*a*) thereof;

a cylinder (1010);

a pressure relief valve (1010*a*) configured on said cylinder (1010);

a piston (1008) reciprocally received in said cylinder (1010);

a connecting rod (1006) having a first end (1006*a*) pivotally connected at said second edge (1002*b*) of said at least one wedge shaped shoe (1002) and a second end (1006*b*) pivotally connected to said piston (1008); and a groove (1004) having a shape complimentary to the shape of said third edge (1002*c*) of said at least one wedge shaped shoe (1002) configured on said elongated element (606) to receive said third edge (1002*c*) of said at least one wedge shaped shoe (1002) therein in a locking mode wherein said cylinder (1010) therein receives a pressurized fluid, thereby displacing said piston (1008) causing a sequence of movements in which said piston displaces said connecting rod (1006) which in turn displaces said second edge (1002*b*) of the at least one wedge shaped shoe, thereby rotating said at least one wedge shaped shoe (1002) around said first edge (1002*a*) thereof moving said third edge (1002*c*) of the at least one wedge shaped shoe into the said groove (1004) in said elongated element (606), thereby locking the movement of said elongated element (606) and hence arresting the movement of said second piston (402); and in a non-locking mode, fluid in said cylinder (1010) is drawn out or pushed out by the force on said second piston (402) due to pressure in said second chamber (400), causing a sequence of movements wherein said piston (1008) is displaced towards the wall of said cylinder (1010), which in turn displaces said connecting rod (1006), which displaces said second edge (1002*b*) thereby rotating said at least one wedge shaped shoe (1002) around said first edge (1002*a*) thereof, slipping said third edge (1002*c*) displaced off from said groove (1004), thereby unlocking said elongated element (606) and hence facilitating the movement of said second piston (402) and the third piston (602).

2. The internal combustion engine (100) as claimed in claim 1, wherein said first chamber (200) comprising:

a first cylinder (204) having a first operative end (204*a*) and a second operative end (204*b*); said pumping means (202) reciprocally disposed in said first cylinder (204), configured to move sliding reciprocally to and from said first operative end (204*a*) and second operative end (204*b*) within said first cylinder (204);

a first cylinder head (206) disposed sealed on said first operative end (204*a*) of said first cylinder (204);

a first space (208) defined by the walls of said first cylinder (204), said first cylinder head (206) and the pumping means (202) to receive air from the atmosphere;

a first inlet port (206*b*) configured in said first cylinder head (206) to draw the air therethrough from the atmosphere or a source thereof into said first chamber (200);

a first inlet valve (206*c*) received within said first inlet port (206*b*);

a first outlet port (206*d*) configured in said first cylinder head (206) to eject the air or the charge therethrough to said second chamber (400);

a cooling jacket (204*c*) disposed optionally on an outer operative surface (2042) of said first cylinder (204) for circulating a cooling fluid therethrough;

a cooling jacket (206*a*) is disposed optionally on an outer operative surface (2062) of said first cylinder head (206) for circulating a cooling fluid therethrough; and a fuel injector optionally provided in the first chamber (200) to add fuel to the air drawn from the atmosphere to form an air fuel mixture or the charge.

3. The internal combustion engine (100) as claimed in claim 2, wherein said first cylinder head (206) comprises a cylindrical barrel (206*e*), having a first end (206*e*1) and a second end (206*e*2); and said second end (206*e*2) is opening in said first space (208).

4. The internal combustion engine (100) as claimed in claim 3, wherein said pumping means (202) is a first piston having a first operative surface (202*a*) and a second operative surface (202*b*);

an elongated element (202*c*) secured to said first piston passing therethrough, having a first portion (202*c*1) disposed above said first operative surface (202*a*) of said first piston and a second portion (202*c*2) disposed below said second operative surface (202*b*) of said first piston; and said first portion (202*c*1) of said elongated element (202*c*) being receivable within said cylindrical barrel (206*e*).

5. The internal combustion engine (100) as claimed in claim 2, wherein said second operative end (204*b*) of said first cylinder (204) is closed and said first space (208) is defined by and/or enclosed within said first cylinder head (206), the walls of said first cylinder (204) and said closed second operative end (204*b*) of said first cylinder (204); said closed second operative end (204*b*) comprises:

a second inlet port (204*bi*) configured to fill an incompressible liquid therethrough into said first chamber (200), to act as a pumping means (202) pumping or pushing the air or the charge into a second chamber (400);

a second inlet valve (204*b*V1) received in said second inlet port (204*bi*);

a second outlet port (204*bo*) configured to remove the incompressible liquid therethrough from said first chamber (200) to draw in air from the atmosphere or a source through said first inlet port (206*b*); and a second outlet valve (204*b*V2) received in the second outlet port (204*bo*).

6. The internal combustion engine (100) as claimed in claim 1, wherein said second chamber (400) comprises:

a second cylinder (404) having a first operative end (404*a*) and a second operative end (404*b*); said second piston (402) reciprocally disposed in said second cylinder (404) configured to move sliding reciprocally to and from said first operative end (404*a*) and said second operative end (404*b*) within said second cylinder (404);

a second cylinder head (406) disposed sealed on said first operative end (404*a*) of said second cylinder (404);

a second space (408) defined by the walls of said second cylinder (404) of said second chamber (400), said second cylinder head (406), and said second piston (402) for receiving there within the air or the charge from said first chamber (200) or from a source of compressed air thereof;

a third inlet port (406*b*) configured in said second cylinder head (406) to receive air or charge from said first chamber (200) via said first outlet port (206*d*) or from a source of compressed air thereof;

a third inlet valve (406*c*) received in said third inlet port (406*b*);

a third outlet port (406*d*) configured in said second cylinder head (406) to eject the exhaust gases therethrough to atmosphere;

a third outlet valve (406*e*) received in said third outlet port (406*d*);

a cooling jacket (404*c*) disposed on an outer operative surface (4042) of said second cylinder (404) for circulating a cooling fluid therethrough;

a cooling jacket (406*a*) disposed on an outer operative surface (4062) of said second cylinder head (406) for circulating a cooling fluid therethrough; and a fuel injector optionally provided in the second chamber (400) to add fuel to the air received from said first chamber (200) to form an air fuel mixture or the charge or to bring about the compression ignition.

7. The internal combustion engine (100) as claimed in claim 1, wherein said third chamber (600) comprises:

a third cylinder (604) having an open first operative end (604*a*), and a closed second operative end (604*b*); said third piston (602) reciprocally disposed in said third cylinder (604) configured to move sliding, reciprocally to and from said open first operative end (604*a*) and said closed second operative end (604*b*) within said third cylinder (604); and said third cylinder (604) disposed operatively next to said second chamber (400), wherein said second operative end (404*b*) of said second cylinder (404) of said second chamber (400) is facing said open first operative end (604*a*) of said third cylinder (604) of said third chamber (600);

an elongated element (606) coupling said second piston (402) and said third piston (602);

a third space (608) defined by said closed second operative end (604*b*), said third piston (602), and the walls of said third cylinder (604) of said third chamber (600) for receiving a fluid therein;

a pipe (610) or a nozzle (610) configured on said closed second operative end (604*b*) of said third cylinder (604) of said third chamber (600) and said pipe (610) or nozzle (610) is configured to selectively facilitate the pumping out of the fluid from said third chamber (600);

a fourth inlet port (612) configured on said closed second operative end (604*b*) of said third cylinder (604) of said third chamber (600), adapted to receive a fluid from a fluid source and facilitate passage of said fluid therethrough into said third chamber (600) from said fluid source; and a fourth inlet valve (614) operably received in said fourth inlet port (612).

8. The internal combustion engine (100) as claimed in claim 7, wherein said open first operative end (604*a*) of said third cylinder (604) of said third chamber (600) is joined sealed with said second operative end (404*b*) of said second cylinder (404) of said second chamber (400); and said second piston (402) and said third piston (602) are optionally coupled operatively by filling a liquid between said second piston (402) and said third piston (602) in place of said elongated element (606).

9. The internal combustion engine (100) as claimed in claim 8, wherein said second piston (402), said third piston (602) and said operative coupling between said second piston (402) and said third piston (602) are removed and a liquid in third chamber (600) is directly subjected to gas force due to pressure in combustion product gases in said second chamber (400).

10. The internal combustion engine (100) as claimed in claim 1, wherein said first locking mechanism (800) is configured on said pipe (610) or nozzle (610) to selectively allow passage of the liquid from said third chamber (600) to a utility and said first locking mechanism (800) comprises:

a housing (802) defined by a cylinder (802*a*) having first operative end (802*a*1) and second operative end (802*a*2), a first end plate (802*b*) disposed sealed on said second operative end (802*a*2) of said cylinder (802*a*) wherein said first end plate (802*b*) is having a first operative surface (802*b*1) and a second operative surface (802*b*2), and a second end plate (802*c*) disposed sealed on said first operative end (802*a*1) of said cylinder (802*a*) wherein said second end plate (802*c*) is having first operative surface (802*c*1) and second operative surface (802*c*2);

a space (808) defined by and/or enclosed in said cylinder (802*a*), said first end plate (802*b*) and said second end plate (802*c*);

a first aperture (802*c*H1) in said second end plate (802*c*);

a second aperture (802*c*H2) in said second end plate (802*c*), spaced apart from said first aperture (802*c*H1);

a first tubular member (806) attached to said first aperture (802*c*H1) on said second operative surface (802*c*2) of said second end plate (802*c*);

a first magnet (802*c*M) attached to said second operative surface (802*c*2) of said second end plate (802*c*), abutting said first tubular member (806);

a third tubular member (810) attached to said second aperture (802*c*H2) on said first operative surface (802*c*1) of said second end plate (802*c*) and disposed extended to outside;

a through-hole (810*h*) provided therein the third tubular member (810);

a first aperture (802*b*H1) in said first end plate (802*b*);

a second aperture (802*b*H2) in said first end plate (802*b*) spaced apart from said first aperture (802*b*H1);

a second tubular member (807) attached to said first aperture (802*b*H1) on said second operative surface (802*b*2) of said first end plate (802*b*);

a second magnet (802*b*M) attached to said second operative surface (802*b*2) of said first end plate (802*b*) abutting said second tubular member (807);

a fourth tubular member (811) attached to said second aperture (802*b*H2) on said first operative surface (802*b*1) of said first end plate (802*b*) and disposed extended to outside;

a through-hole (811*h*) provided therein in the third tubular member (811);

a substantially cylindrical chunk (804) having a first operative surface (804*a*1) and a second operative surface (804*a*2) made of metal from group of metals including iron, cobalt, nickel which are attracted by magnets, disposed in said space (808) configured to move sliding reciprocally to and from said first operative end (802*a*1) and said second operative end (802*b*1) of said cylinder (802*a*);

a first elongated bar (806*a*) having a first end (806*a*1) and a second end (806*a*2) disposed attached to said first operative surface (804*a*1) of said substantially cylindrical chunk (804) with said second end (806*a*2) and said first end (806*a*1) of said first elongated bar (806*a*) is displaceably received in said first tubular member (806);

a second elongated bar (807*a*) having a first end (807*a*1) and a second end (807*a*2) disposed attached to said second operative surface (804*a*2) of said substantially cylindrical chunk (804) with said second end (807*a*2) and said first end (807*a*1) of said second elongated bar (807*a*) is displaceably received in said first tubular member (807);

a third elongated bar (810*a*) having a first end (810*a*1), a second end (810*a*2) and hole (810*ah*) substantially close to the first end (810*a*1) disposed attached to said first operative surface (804*a*1) of said substantially cylindrical chunk (804) with said second end (810*a*2) spaced apart from first elongated bar (806*a*) and said first end (810*a*1) of said third elongated bar (810*a*) is displaceably received in said third tubular member (810); and a fourth elongated bar (811*a*) having a first end (811*a*1), a second end (811*a*2) and hole (811*ah*) substantially close to the first end (811*a*1) disposed attached to said second operative surface (804*a*2) of said substantially cylindrical chunk (804) with said second end (811*a*2) spaced apart from second elongated bar (807*a*) and said first end (811*a*1) of said fourth elongated bar (811*a*) is displaceably received in said third tubular member (811).

11. The internal combustion engine (100) as claimed in claim 10, wherein said first locking mechanism (800) is connected to said pipe (610) or nozzle (610) comprising:

an aperture (610*ap*) configured in the wall of said pipe (610) or nozzle (610), to which said first aperture (802*c*H1) in said second end plate (802*c*) of said first locking mechanism (800) is joined forming a watertight passage through said first aperture (610*ap*) in the wall of pipe (610) or nozzle (610), said first aperture (802*c*H1) in the second end plate (802*c*) and said first tubular member (806) on the second end plate (802*c*) wherein, said first elongated bar (806*a*) is received disposed reciprocally displaceable; and a through hole (610H) configured in the wall of said pipe (610) or nozzle (610) wherein said third tubular member (810) on the second end plate (802*c*) enters such that said through hole (810*h*) in said third tubular member register in line with the pipe or the nozzle allowing flow of the fluid and said third elongated bar (810*a*) is disposed reciprocally displaceable in said third tubular member (810) to selectively block the flow of the fluid through the pipe or the nozzle.

12. The internal combustion engine as claimed in claim 11, wherein said first locking mechanism (800) is shared with a second internal combustion engine (100) connected to said pipe (610) or nozzle (610) of said second internal combustion engine (100) comprising:

an aperture (610*ap*) configured in the wall of said pipe (610) or nozzle (610), to which said first aperture (802*b*H1) in said first end plate (802*b*) of said first locking mechanism (800) is joined forming a watertight passage through said first aperture (610*ap*) in the wall of pipe (610) or nozzle (610), said first aperture (802*b*H1) in the first end plate (802*b*) and said second tubular member (807) on the first end plate (802*b*) wherein, the first elongated bar (807*a*) is received disposed reciprocally displaceable; and a through hole (610H) configured in the wall of said pipe (610) or nozzle (610) wherein said fourth tubular member (811) on the first end plate (802*b*) enters such that said through hole (811*h*) in said fourth tubular member (811) register in line with the pipe or the nozzle allowing flow of the fluid and said fourth elongated bar (811*a*) is disposed reciprocally displaceable in said fourth tubular member (811) to selectively block the flow of the fluid through the pipe or the nozzle.

13. The internal combustion engine (100) as claimed in claim 2, wherein a rack and pinion mechanism (1200) is disposed operatively above said first cylinder head (206) and said second cylinder head (406), wherein said rack and pinion mechanism (1200) comprises:

a rack (1202) having a first end (1202*a*) and a second end (1202*b*), said first end (1202*a*) along with a portion of said rack (1202) is protruding into said first space (208) in said first chamber (200) through an aperture in said first cylinder head (206) in a sealable manner; and said second end (1202*b*) is coupled to a resilient member (1208);

a pinion (1204) meshing with said rack, said pinion disposed rotating on a support; and a cam (1206) meshing with said pinion (1204), disposed rotating on a support, said cam (1206) coupled to said third inlet valve (406*c*);

wherein said first piston (202) comes in contact with the said first end (1202*a*) in the process of pumping out the air or the charge from said first chamber (200), and pushes said first end (1202*a*) thereby moving said rack (1202) compressing said resilient member (1208); and said pinion (1204) is rotated which in turn rotates said cam (1206) moving the cam off from said third inlet valve (406*c*) allowing said third inlet valve (406*c*) to close.

14. The internal combustion engine (100) as claimed in claim 7, wherein said at least one fluid pump (616) in said third chamber (600) comprises:

a cylindrical chamber (616*a*) closed on both ends having a first operative end (616*a*1) facing said closed second operative end (604*b*) of said third cylinder (604) and a second operative end (616*a*2) towards said open first operative end (604*a*) of said third cylinder (604);

a first opening (616*c*) to said cylindrical chamber (616*a*) in said first operative end (616*a*1);

a second opening (616*d*1) to said cylindrical chamber (616*a*) in the second operative end (616*a*2) receiving therein a outlet valve through which fluid is ejected from said cylindrical chamber (616*a*);

a third opening (616*d*2) to said cylindrical chamber (616*a*) in the second operative end (616*a*2) receiving therein an inlet valve through which fluid is received into said cylindrical chamber (616*a*);

a piston (616*b*) having a first operative surface (616*b*1) facing said second operative end (616*a*2) of the cylindrical chamber (616*a*) and a second operative surface (616*b*2) facing said first operative end (616*a*1) of the cylindrical chamber (616*a*), reciprocally disposed to move sliding in the cylindrical chamber (616*a*);

an elongated element (616*b*E) secured to the second operative surface (616*b*2) of the piston (616*b*) and emerging out of the cylindrical chamber (616*a*) through the first opening (616*c*), a resilient member/spring is attached to the free end of the elongated element (616*b*E); wherein the elongated element (616*b*E) comes in contact with said third piston (602) just before the conclusion of exhaust stroke pushing the elongated element (616*b*E) along with piston (616*b*) towards second operative end pushing out the fluid in cylindrical chamber (616*a*); and at the commencement of the power stroke as said third piston (602) move towards said closed second operative end (604*b*), the elongated element (616*b*E) is detached from the contact of said third piston (602), the restoring forces in resilient member or spring attached to elongated element (616*b*E) pull out the elongated element (616*b*E) from the cylindrical chamber (616*a*) moving the piston (616*b*) to first operative end (616*a*1) drawing in fluid into the cylindrical chamber (616*a*).

15. The internal combustion engine (100) as claimed in claim 12, wherein said at least one fluid pump (812) in said first locking mechanism (800) comprises:

a closed cylindrical chamber (812*a*) having a first operative end (812*a*1) attached to said second operative surface (802*c*2) of the second end plate (802*c*) and a second operative end (812*a*2) extended into said space (808) facing said first operative surface (804*a*1) of said substantially cylindrical chunk (804);

a first opening (812*c*) in the wall on said second operative end (812*a*2) facing said first operative surface (804*a*1) of said substantially cylindrical chunk (804);

a second opening (812*d*1) in the wall on said first operative end (812*a*1), receiving a outlet valve through which fluid is ejected from said cylindrical chamber (812*a*);

a third opening (812*d*2) in the wall on said first operative end (812*a*1), receiving a inlet valve through which fluid is received into said cylindrical chamber (812*a*);

a piston (812*b*) is reciprocally disposed within said cylindrical chamber (812*a*) configured to move sliding to and from said first operative end (812*a*1) and said second operative end (812*a*2) within said cylindrical chamber (812*a*);

a connecting rod (812*br*) having one end connected to the piston (812*b*) and other end connected to the first operative surface (804*a*1) of substantially cylindrical chunk (804) passing through the first opening (812*c*); wherein the displacement of said substantially cylindrical chunk (804) away from said second end plate (802*c*) displace said piston (812*b*) drawing in fluid through said third opening (812*d*2) into said cylindrical chamber (812*a*) and the displacement of said substantially cylindrical chunk (804) towards said second end plate (802*c*) displace said piston (812*b*) pumping out fluid from said cylindrical chamber (812*a*) through said second opening (812*d*1).

16. The internal combustion engine (100) as claimed in claim 15, wherein said at least one fluid pump (814) in said first locking mechanism (800) comprises:

a closed cylindrical chamber (814*a*) having a first operative end (814*a*1) attached to said second operative surface (802*b*2) of the first end plate (802*b*) and a second operative end (814*a*2) extended into said space (808) facing said second operative surface (804*a*2) of said substantially cylindrical chunk (804);

a first opening (814*c*) in the wall on said second operative end (814*a*2) facing said second operative surface (804*a*2) of said substantially cylindrical chunk (804);

a second opening (814*d*1) in the wall on said first operative end (814*a*1), receiving a outlet valve through which fluid is ejected from said cylindrical chamber (814*a*);

a third opening (814*d*2) in the wall on said first operative end (814*a*1), receiving a inlet valve through which fluid is received into said cylindrical chamber (814*a*);

a piston (814*b*) is reciprocally disposed within said cylindrical chamber (814*a*) configured to move sliding to and from said first operative end (814*a*1) and said second operative end (814*a*2) within said cylindrical chamber (814*a*);

a connecting rod (814*br*) having one end connected to the piston (814*b*) and other end connected to the second operative surface (804*a*2) of substantially cylindrical chunk (804) passing through the first opening (814*c*); wherein the displacement of said substantially cylindrical chunk (804) away from said first end plate (802*b*) displace said piston (814*b*) drawing in fluid through said third opening (814*d*2) into said cylindrical chamber (814*a*) and the displacement of said substantially cylindrical chunk (804) towards said first end plate (802*b*) displace said piston (814*b*) pumping out fluid from said cylindrical chamber (814*a*) through said second opening (814*d*1).

17. The internal combustion engine (100) as claimed in claim 1, wherein the valves in any one of the or in all the ports in said internal combustion engine (100), particularly said first inlet port (206*b*), said second inlet port (204*bi*), said third inlet port (406*b*), said second outlet port (204*bo*), said third outlet port (406*d*) and said fourth inlet port (612) is/are actuated by a hydraulic valve system comprising at least one fluid pump (616) in third chamber (600), at least one fluid pump (812) in lock mechanism (800) and at least one fluid pump (814) in lock mechanism (800) connected through conduits and valves.

18. The internal combustion engine (100) as claimed in claim 1, wherein said first chamber (200) is an air or charge injector, said second chamber (400) is a combustion chamber, and said third chamber (600) is an ejector.

19. An electric power generating system comprising:

at least one said internal combustion engine (100) as claimed in any of the preceding claims;

a funnel shaped container (1402) having a broad end and a narrow end; wherein said internal combustion engine or said internal combustion engines is/are operatively coupled to said funnel shaped container on broad end to discharge liquid into said funnel shaped container and said liquid is allowed to flow out from the narrow end of the funnel shaped container;

a turbine operatively coupled to said narrow end of the funnel shaped container and said turbine is rotated by said liquid flowing out from said narrow end of the funnel shaped container;

a dynamo or an alternator or electric power producing equipment selected from the group consisting of dynamo and alternator, operatively coupled to the turbine to generate electric power.

* * * * *